US008619016B2

(12) United States Patent
Oelhafen et al.

(10) Patent No.: US 8,619,016 B2
(45) Date of Patent: Dec. 31, 2013

(54) APPARATUS AND METHOD FOR COLOR SHIFT COMPENSATION IN DISPLAYS

(75) Inventors: Patrick Oelhafen, Shanghai (CN); Patrick Brunner, Zurich (CH)

(73) Assignee: Entropic Communications, Inc., San Diego, CA (US)

( * ) Notice: Subject to any disclaimer, the term of this patent is extended or adjusted under 35 U.S.C. 154(b) by 1052 days.

(21) Appl. No.: 12/097,638

(22) PCT Filed: Dec. 8, 2006

(86) PCT No.: PCT/IB2006/054693

§ 371 (c)(1),
(2), (4) Date: Jan. 15, 2009

(87) PCT Pub. No.: WO2007/069159

PCT Pub. Date: Jun. 21, 2007

(65) Prior Publication Data

US 2010/0013864 A1 Jan. 21, 2010

(30) Foreign Application Priority Data

Dec. 16, 2005 (EP) ..... 05112275

(51) Int. Cl.
*G09G 3/36* (2006.01)

(52) U.S. Cl.
USPC ..... 345/100; 345/96; 345/209

(58) Field of Classification Search
USPC ..... 345/38, 50–54, 60, 64, 87–104; 348/34, 348/217.1, 297, 777
See application file for complete search history.

(56) References Cited

U.S. PATENT DOCUMENTS

| | | | | |
|---|---|---|---|---|
| 2001/0050665 | A1 | 12/2001 | Yeo et al. | |
| 2005/0035934 | A1 | 2/2005 | Kitani et al. | |
| 2005/0140633 | A1 * | 6/2005 | Kato | 345/96 |
| 2005/0200788 | A1 * | 9/2005 | Edwards | 349/139 |
| 2005/0280621 | A1 * | 12/2005 | Tsutsui et al. | 345/90 |

FOREIGN PATENT DOCUMENTS

| | | |
|---|---|---|
| CN | 1617016 | 5/2005 |
| JP | 2001324963 | 11/2001 |
| JP | 2005250065 | 9/2005 |

* cited by examiner

*Primary Examiner* — Amare Mengistu
*Assistant Examiner* — Vinh Lam
(74) *Attorney, Agent, or Firm* — Bruce Greenhaus; Richard Bachand; Duane Morris LLP

(57) ABSTRACT

Active matrix display module (10) comprising a driving circuit with a source driver (20) and a gate driver (12). Furthermore, a display panel (11) with pixels consisting of three sub-pixels is provided. The sub-pixels are arranged in rows and columns and each sub-pixel comprises a sub-pixel selection transistor arranged at an intersection of a row and a column. The gate driver (12) is employed to select and deselect all pixels of a row of the display panel (11) and the source driver (20) is employed for providing the required voltage levels to all sub-pixels of a currently selected row, said voltage levels corresponding to the desired intensity for each color. Demultiplexer switches (21) are integrated onto the display panel (11) for demultiplexing columns of the display panel (11). The active matrix display module (10) further comprises means (18) for color shift compensation. These means (18) implement a selection order for the selection of the sub-pixels to compensate unintentional color shifts. The compensation takes place within two frames.

2 Claims, 29 Drawing Sheets

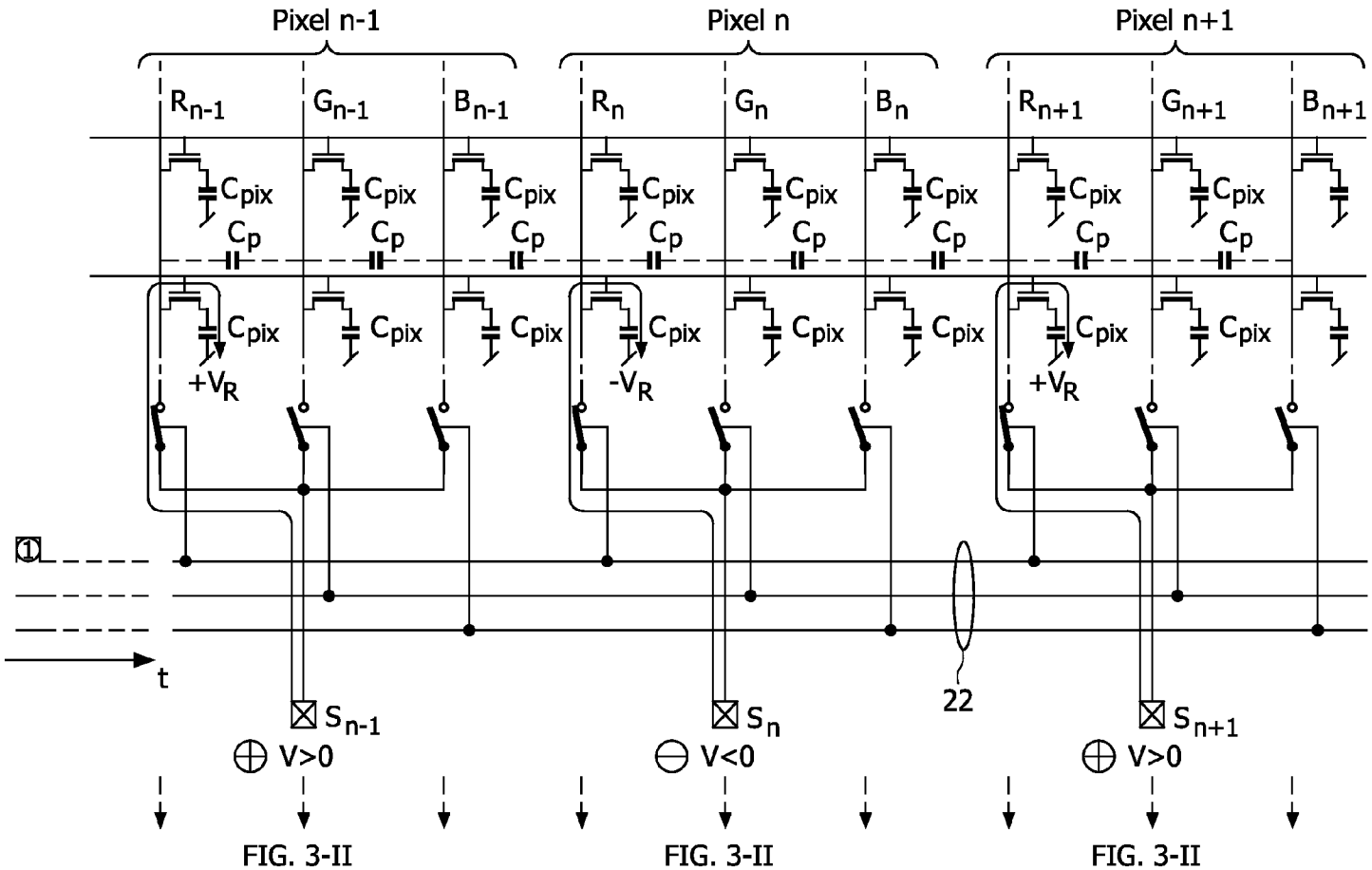
FIG. 3-I

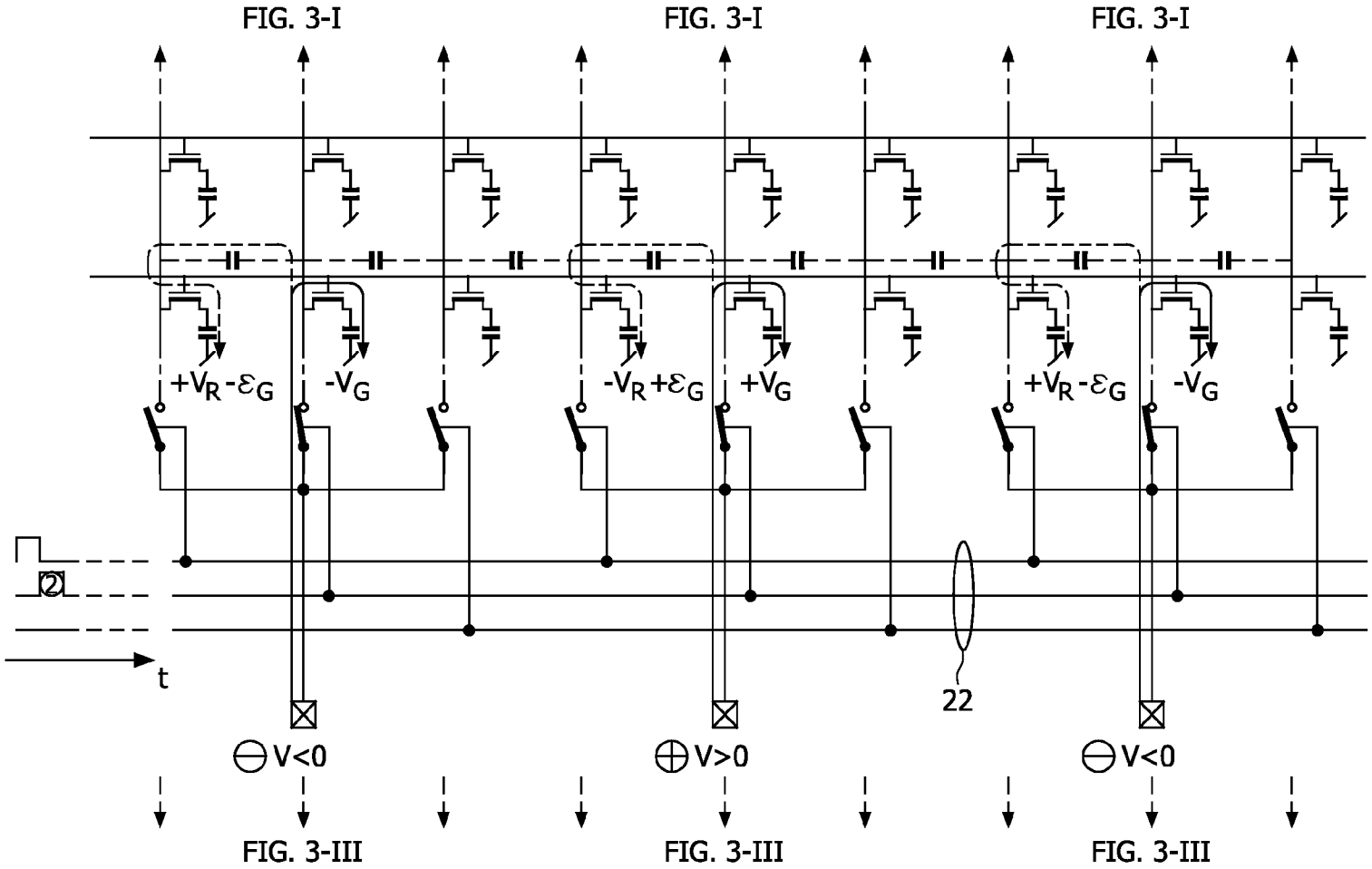
FIG. 3-II

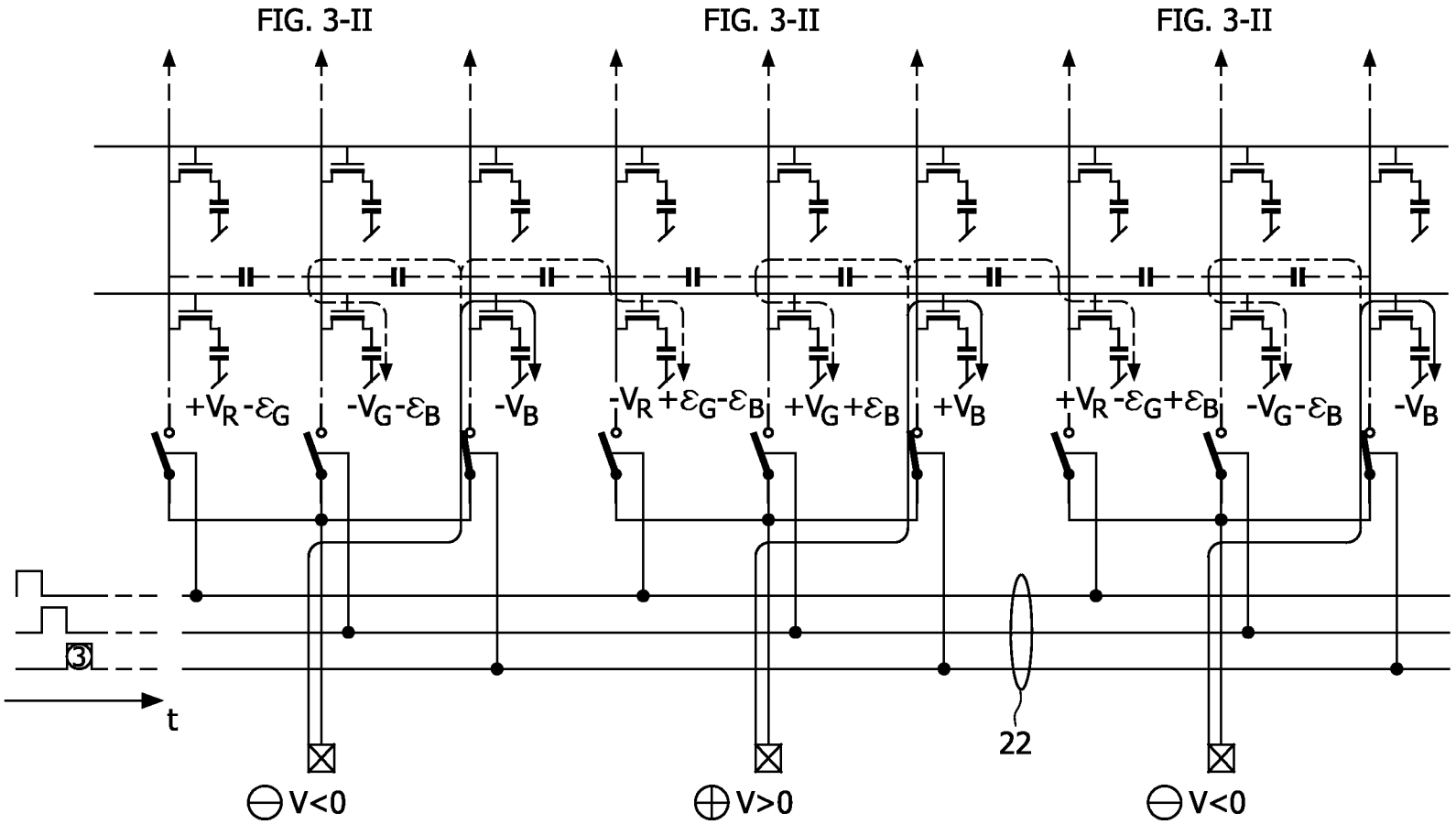
FIG. 3-III

APPARATUS AND METHOD FOR COLOR SHIFT COMPENSATION IN DISPLAYS

The invention concerns active matrix display modules and methods for the color shift compensation implemented in active matrix display modules.

The driving circuit for an active matrix LCD (AMLCD) can be divided in two parts: a source and a gate driver. The gate driver controls the gates of the on glass transistors to select and deselect all pixels of a specific row. Each pixel consists of three sub-pixels (red, green, blue) and each sub-pixel has its own storage capacitor. The source drivers provide the required voltage level to all sub-pixels of the currently selected row corresponding to the desired intensity for each color. The final color is obtained by the ability of the human eye to mix combinations of the three base colors (red, green, blue) into one.

When the previously selected row is deselected by the gate driver, all of this row's sub-pixels become isolated and the voltage level for each sub-pixel is maintained by a storage capacitor and a pixel capacitance. The period, in which every display row is selected exactly once, is typically referred to as a 'frame'.

In FIG. 1 an example of an active matrix LTPS (low temperature polysilicon) display module 10 is schematically depicted. In this LTPS display module 10, the gate driver circuit 12 is integrated directly into the display glass 11. This is possible since the gate driver 12 typically only comprises circuits that can easily be implemented on the display glass 11. Note that in theory, the gate driver could reside in a separate chip as well. The source drivers can either be integrated on-glass or in a separate chip. In FIG. 1 an embodiment is shown where the demultiplexers 13 are integrated on the display glass 11. The multiplexers 14, source output drivers 15, latches 16, buffer 17 and control circuit 18 are realized in a separate source driver chip 20. The display panel has in the present example N columns and M rows. If a multiplexing rate of 1:3 is employed, only N/3 source driver lines 19 are required to connect the source driver chip 20 with the display panel 11. The LTPS technology allows the integration of demultiplexers on the display glass which dramatically reduces the amount of required source driver lines 19. LTPS is an example only. The invention which will be addressed later is not LTPS specific.

In cases where the source driver circuit is integrated on-chip, too, the on-glass demultiplexing method reduces the amount of source output pads needed to drive a specific display size. Or, in other words, it increases the possible display size that can be driven by a single chip. In case of multiplexing, the source lines are grouped, e.g. 3 sub-pixels per multiplexing group for a mux rate of 1:3 or 6 sub-pixels per multiplexing group for a mux rate of 1:6. When a row is selected, the sub-pixels therein are not charged all at the same time but the source lines of one group are charged sequentially. For instance in a multiplexing 1:3 case, first all red sub-pixels are selected, then all green sub-pixels, and finally all blue sub-pixels. After that, the row is deselected, and the next row becomes selected, followed again by charging the red sub-pixels, and so on. This case is schematically illustrated in FIG. 2. In this Figure two rows $R_{N+1}$ and $R_N$ and three columns n−1, n, n+1 are illustrated. Each pixel has, as mentioned above, three sub-pixels. In FIG. 2 the sub-pixels of column n−1 are denoted as (red) $R_{n-1}$, (green) $G_{n-1}$, and (blue) $B_{n-1}$. The source driver lines 19 are denoted as $S_{n-1}$, $S_n$, and $S_{n+1}$. The switches of the demultiplexer 13 carry the reference number 21 and the demultiplexer selection lines carry the reference number 22. $C_p$ are the parasitic capacitances between two adjacent source lines and $C_{pix}$ are the pixel capacitances. Furthermore, each sub-pixel comprises a sub-pixel selection transistor arranged at an intersection of a row and a column. One such sub-pixel selection transistor carries the reference number 23.

The drawback of the demultiplexing method is the so-called color shift. When a row is selected, all the on-glass sub-pixel selection transistors 23 for this row are conducting. As shown in FIG. 3, charging a sub-pixel influences the neighboring pixels (which were charged before) through the parasitic capacitances $C_p$ between two lines (mainly the adjacent lines). The demultiplexer selection signals are shown on the left hand side right next to the demultiplexer selection lines 22. In FIG. 3 the color shift is denoted by $\epsilon B$ & $\epsilon G$. Therefore, only the sub-pixels which were charged as the last ones in a row, carry the correct voltage level when the row becomes deselected (the blue sub-pixel in case of FIG. 3).

The state of the art technique to compensate the color shift effect is to rotate the pixel order selection from frame to frame. In this way, the last charged pixels (those with the correct color) of a specific row are in each frame different. The color of the last selected sub-pixel is then correct and the error on each sub-pixel partially averages out over 3 frames for a mux-rate of 1:3 (or 6 frames for mux-rate 1:6, respectively). Depending on the frame frequency and on the multiplexing factor the amount of required frames to average out the errors might become too long and will be perceived as flicker on the display. Especially for high multiplexing rates, a high frame frequency must be applied to avoid flickering.

The drawback of this method is, that the color shift is only slowly compensated (over several frames) and a certain deviance will always remain.

It is an object of the present invention to provide a better and faster color compensation scheme.

According to the present invention, the color shift is compensated using a smart selection order for the sub-pixels. According to the present invention the compensation takes place within two frames. During the first frame the color shift is partially compensated and during the second frame, the color shift is completely compensated.

According to the present invention an active matrix display module is provided that comprises a driving circuit with a source driver and a gate driver. Furthermore, a display panel with pixels consisting of three sub-pixels is provided. The sub-pixels are arranged in rows and columns and each sub-pixel comprises a sub-pixel selection transistor arranged at an intersection of a row and a column. The gate driver is employed to select and deselect all pixels of a row of the display panel and the source driver is employed for providing the required voltage levels to all sub-pixels of a currently selected row, said voltage levels corresponding to the desired intensity for each color. Demultiplexer switches are integrated onto the display panel for demultiplexing rows of the display panel. The active matrix display module further comprises means for color shift compensation. These means implement a selection order for the selection of the sub-pixels to compensate unintentional color shifts. The compensation takes place within two frames.

Further advantageous embodiments are addressed in connection with the detailed description.

For a more complete description of the present invention and for further objects and advantages thereof, reference is made to the following description, taken in conjunction with the accompanying drawings, in which:

FIG. 3 is a schematic representation showing part of a conventional active matrix display module and a prior art selection scheme;

Figure 1:
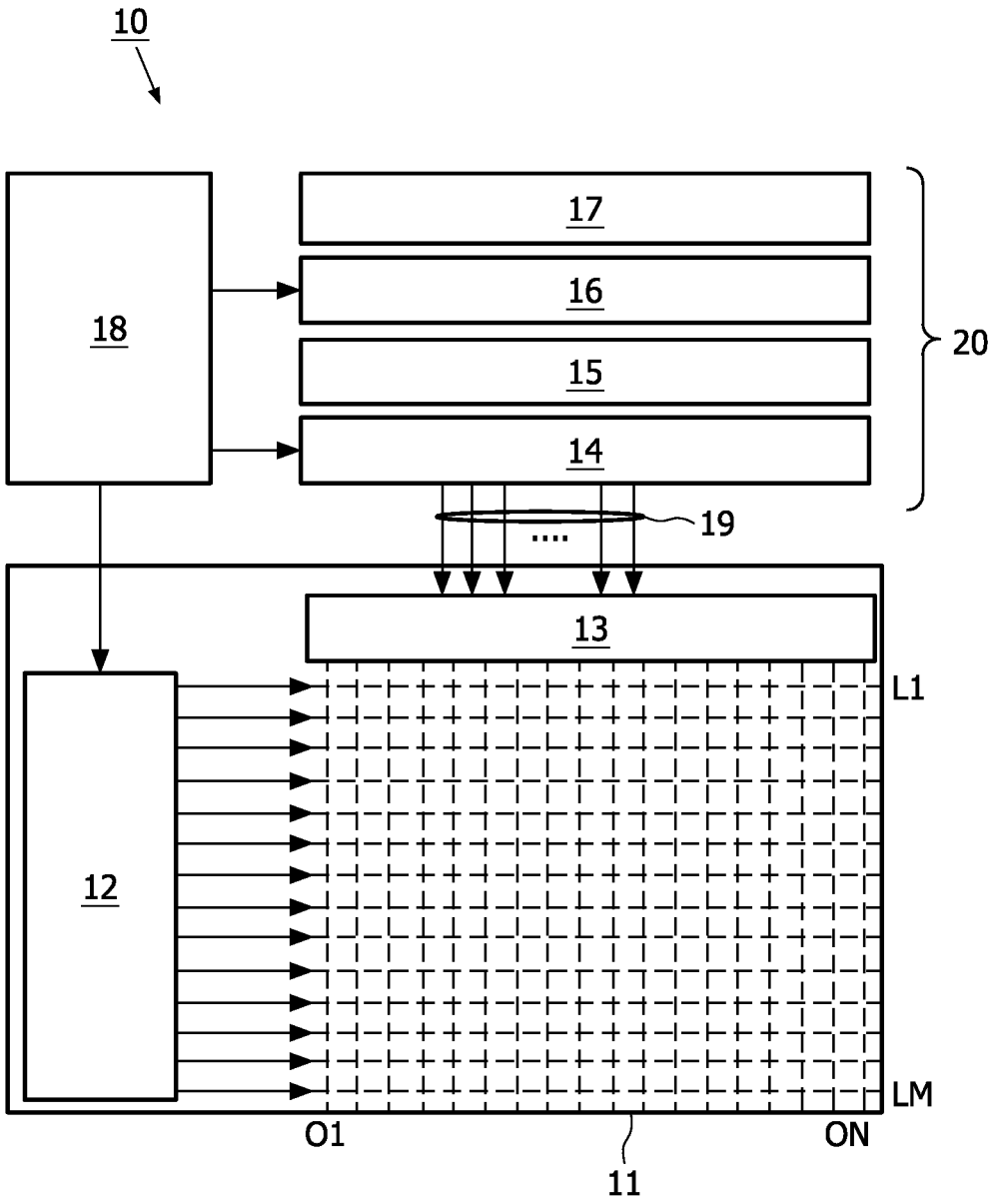
FIG. 1 is a schematic representation of a typical active matrix display module.
Figure 2:
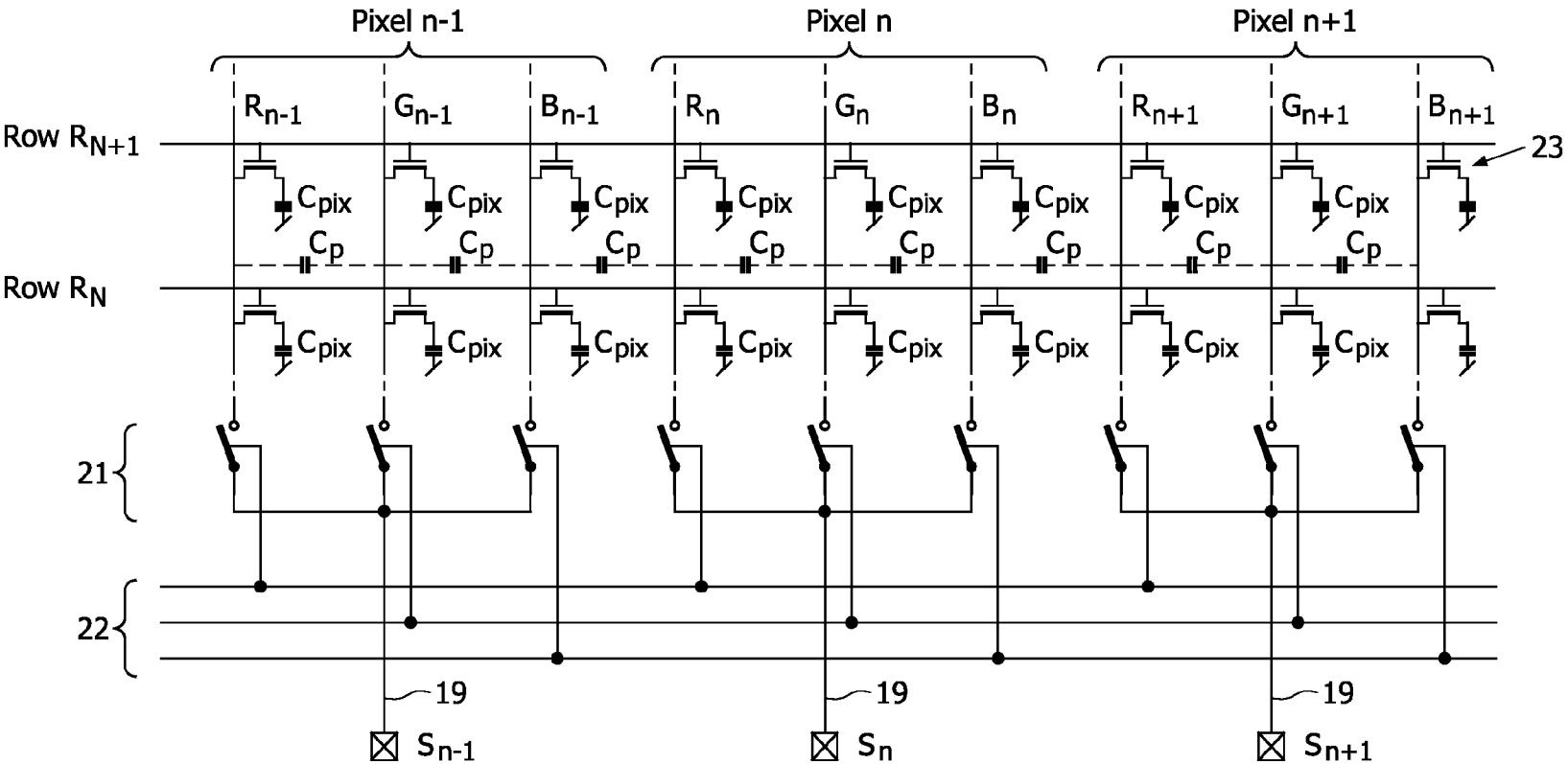
FIG. 2 is a schematic representation showing part of a conventional active matrix display module.

According to the present invention, the color shift is compensated by a smart selection order employed when selecting the sub-pixels. This is done within two frames.

In the first frame, the color shift is partially compensated, and in the second frame completely. In this way, flicker (which might be present in the prior art solution) is avoided.

The inventive selection order proposed herein is also chosen to minimize power consumption.

The basic idea is based on the following physical properties:

1. Assuming a row is selected and the sub-pixel n of this row has been charged: If the adjacent sub-pixel n+1 and the adjacent sub-pixel n−1 of this row are charged with opposite voltage polarities (one with a positive voltage and the other with a negative voltage), then the color shift on the pixel n is attenuated (partially compensated).
2. Assuming a row is selected and two adjacent sub-pixels of this row are selected at the same time: In this case, the voltage level charged on either sub-pixel does not have an impact on the voltage level charged on the other one.
3. The sub-pixel selection order can be chosen in such a way that in one frame the same absolute value of color shift as in the next frame is obtained but with opposite polarity. In this way the color shift is averaged out over two frames.
4. Assuming a row is selected and a sub-pixel n from this row has already been charged. If now the next sub-pixel (e.g., sub-pixel n−2, n−3, . . . or sub-pixel n+2, n+3, . . . ), which is not adjacent to sub-pixel n, is being charged, then the color shift on sub-pixel n is considered to be very small.

Two different embodiments of this smart color shift compensation are now addressed in connection with the corresponding drawings.

Before addressing the two exemplary embodiments, some basic aspects of the schematic drawings are explained.

In the Figures, part of a display panel 11 is shown. The display panel 11 comprises pixels consisting of three sub-pixels ($R_n$, $G_n$, $B_n$). The sub-pixels are arranged in rows where the row line (horizontal) is called gate line. Each sub-pixel comprises a sub-pixel selection transistor 23 arranged at an intersection of a row and a column. The sub-pixel selection transistors 23 in a row are all connected to individual, i.e. different, data lines (vertical/column lines). A gate driver 12 is employed to select and deselect all pixels of a row of the display panel 11. A source driver 20 provides the required voltage levels to all sub-pixels of a currently selected row of said display panel 11, said voltage levels corresponding to the desired intensity for each color.

Figure 4A:
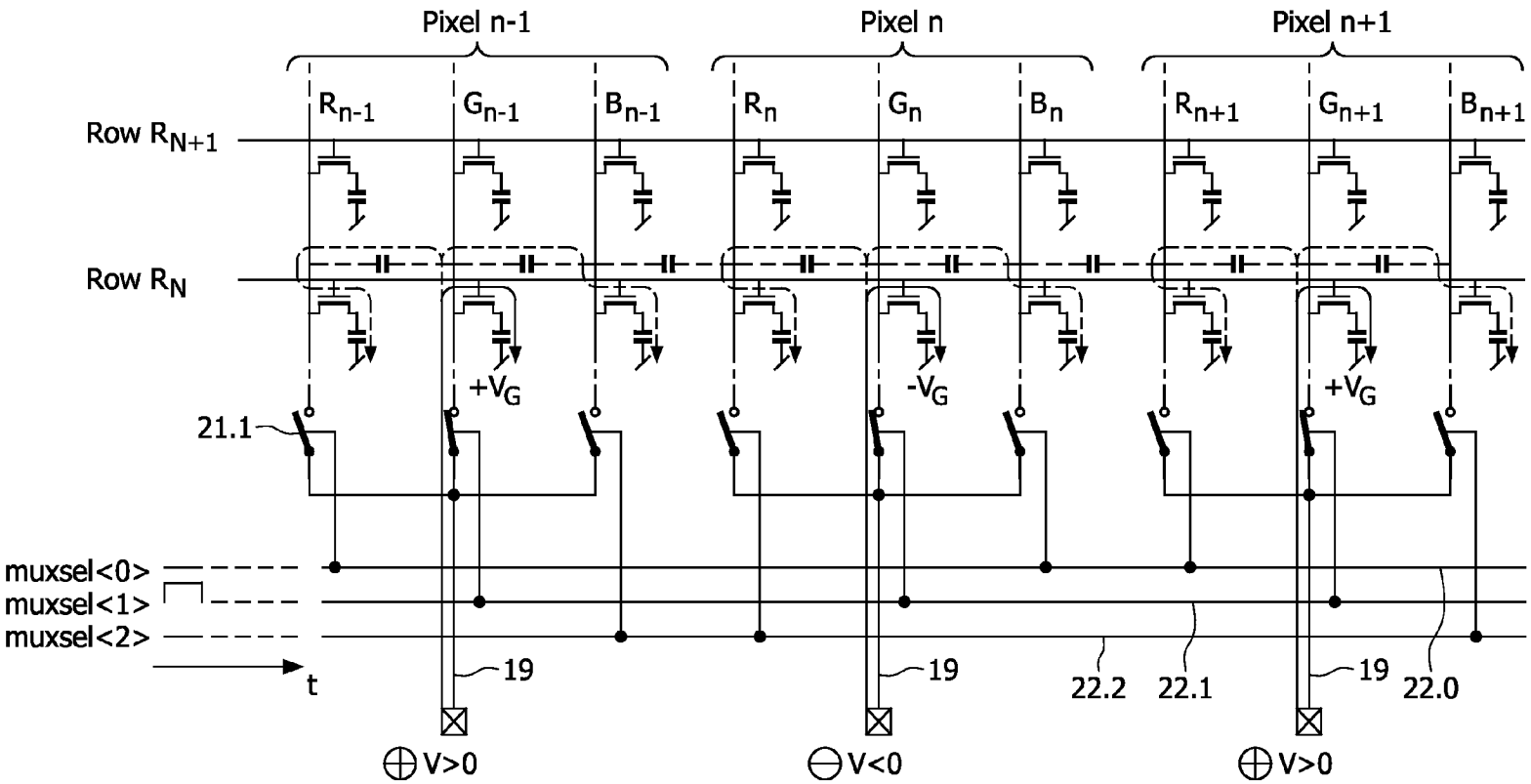
FIGS. 4A-4C are a schematic representation showing part of an active matrix display module and details of the inventive selection scheme and the steps carried out during a first frame.

If a multiplexed display implementation is used, the corresponding demultiplexer switches may be integrated onto the display panel 11 for demultiplexing the data lines of the display panel 11. In FIG. 4A one demultiplexer switch is denoted as 21.1.

The control circuit 18 may comprise a demultiplexer logic or a sequencer to control the demultiplexer switches 21 in accordance with the present invention. That is, the control circuit 18 provides the right signals in order to switch the demultiplexer switches 21 so that the above-identified properties are satisfied.

A first embodiment of the invention is designed for a multiplexing rate (mux rate) of 1:3. In this particular embodiment the above-mentioned properties 1, 2, and 3 are being used. It is to be noted that according to the invention other selection orders than described here are possible too.

Figure 4B:
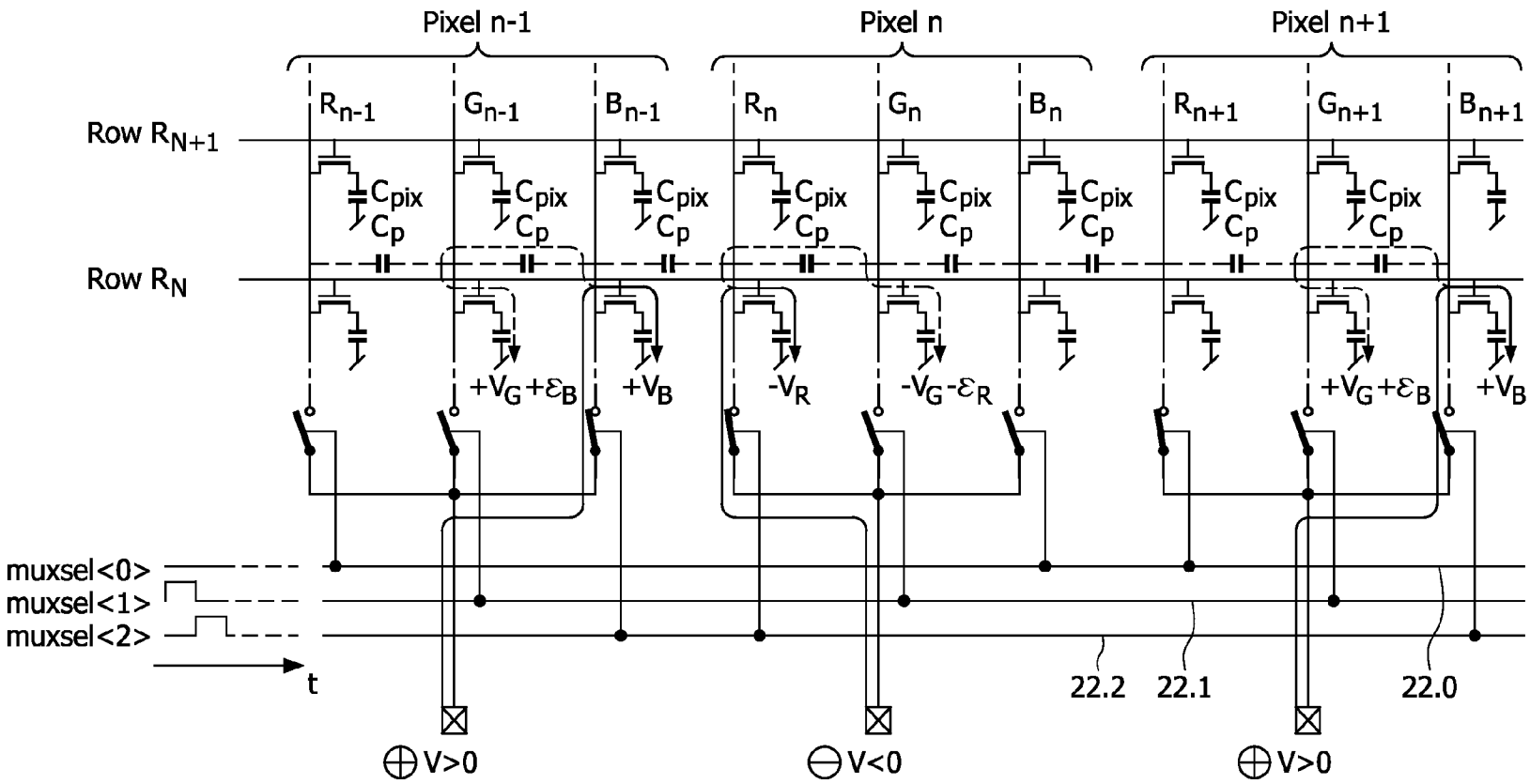

In the following one possible solution is explained, where the charging of the pixels is divided into the following steps: Frame 1 (see FIGS. 4A through 4C):

1. The row $R_N$ is selected by the gate driver 12.
2. All sub-pixels ($G_{n-1}$, $G_n$, and $G_{n+1}$) in the middle of respective multiplexing groups of the row $R_N$ are charged (cf. FIG. 4A). This is done by applying a respective signal pulse muxsel <1> on the corresponding demultiplexer selection line 22.1 so that the demultiplexer selection line 22.1 becomes a logic one for a short period of time. Note that the sub-pixel $G_{n-1}$ is charged with a positive, the sub-pixel $G_n$ with a negative, and the sub-pixel $G_{n+1}$ with a positive voltage, as indicated right next to the source driver lines 19.
3. One of the neighboring sub-pixels (sub-pixel $B_{n-1}$ in the present example) is charged with one voltage polarity (assuming positive), since the respective signal pulse muxsel <2> on the corresponding demultiplexer selection line 22.2 is a logic one for a short period of time. In order to take advantage of property 2, the adjacent sub-pixel (sub-pixel $R_n$ in the present example) of the adjacent multiplexing group is selected at the same time (in this way these two sub-pixels ($B_{n-1}$ and $R_n$) are not influencing each other) (cf. FIG. 4B, $V_R$ is not influenced by $V_B$). As shown in FIG. 4B, signal pulse muxel <2> on a demultiplexer selection line 22.2 is also coupled to control the voltage level for sub-pixel $B_{n+1}$ via a corresponding demultiplexer switch, and the same voltage polarity (in this example, positive) is used for charding sub-pixel $B_{n+1}$ via that switch as is used for charging sub-pixel $B_{n-1}$.
4. Then, the other neighbor (sub-pixel $R_{n-1}$ in the present example) of the middle sub-pixel (sub-pixel $G_{n-1}$ in the present example) is charged with the opposite voltage polarity (assuming negative), since the respective signal pulse muxsel <0> on the corresponding demultiplexer selection line 22.0 is a logic one for a short period of time. This takes advantage of property 1 (in this way the influence on the sub-pixel in the middle (sub-pixel $G_{n-1}$ in the present example) is partially attenuated). Like in step 2 above, the two adjacent sub-pixels ($B_n$ and $R_{n+1}$) of the two adjacent multiplexing groups are selected simultaneously. In this way, these two sub-pixels ($B_n$ and $R_{n+1}$) are not influenced by each other. Finally, all pixels of the row $R_N$ have been charged and the only sub-pixel suffering slightly from color shift is the sub-pixel in the middle (cf. FIG. 4C).

5. The previous steps are repeated for every row until the whole display has been addressed.

In this way the frame 1 has been completed.

Figure 5A:
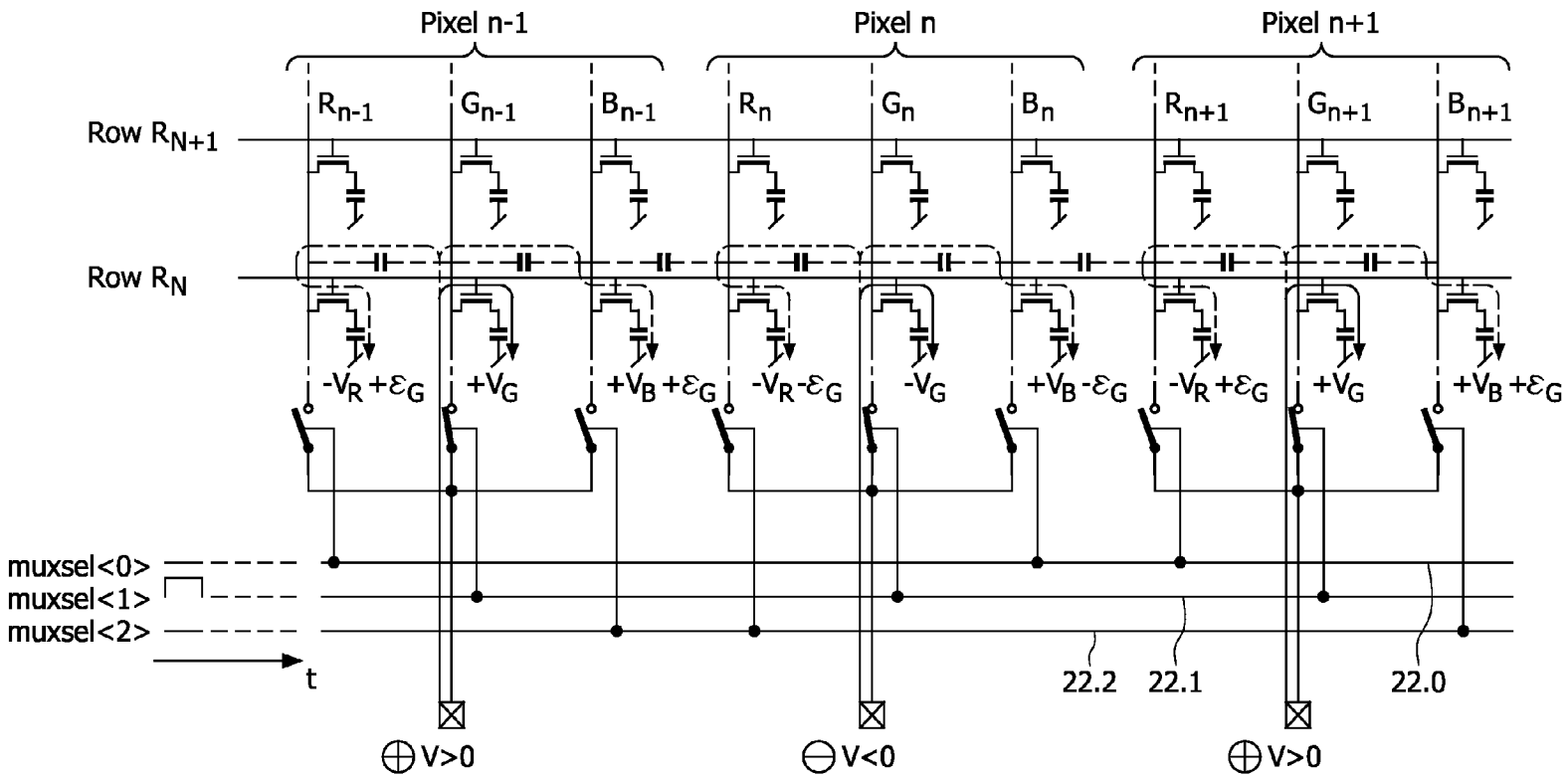
FIGS. 5A-5C are a schematic representation showing part of an active matrix display module and details of the inventive selection scheme and the steps carried out during a second frame.
Figure 5B:
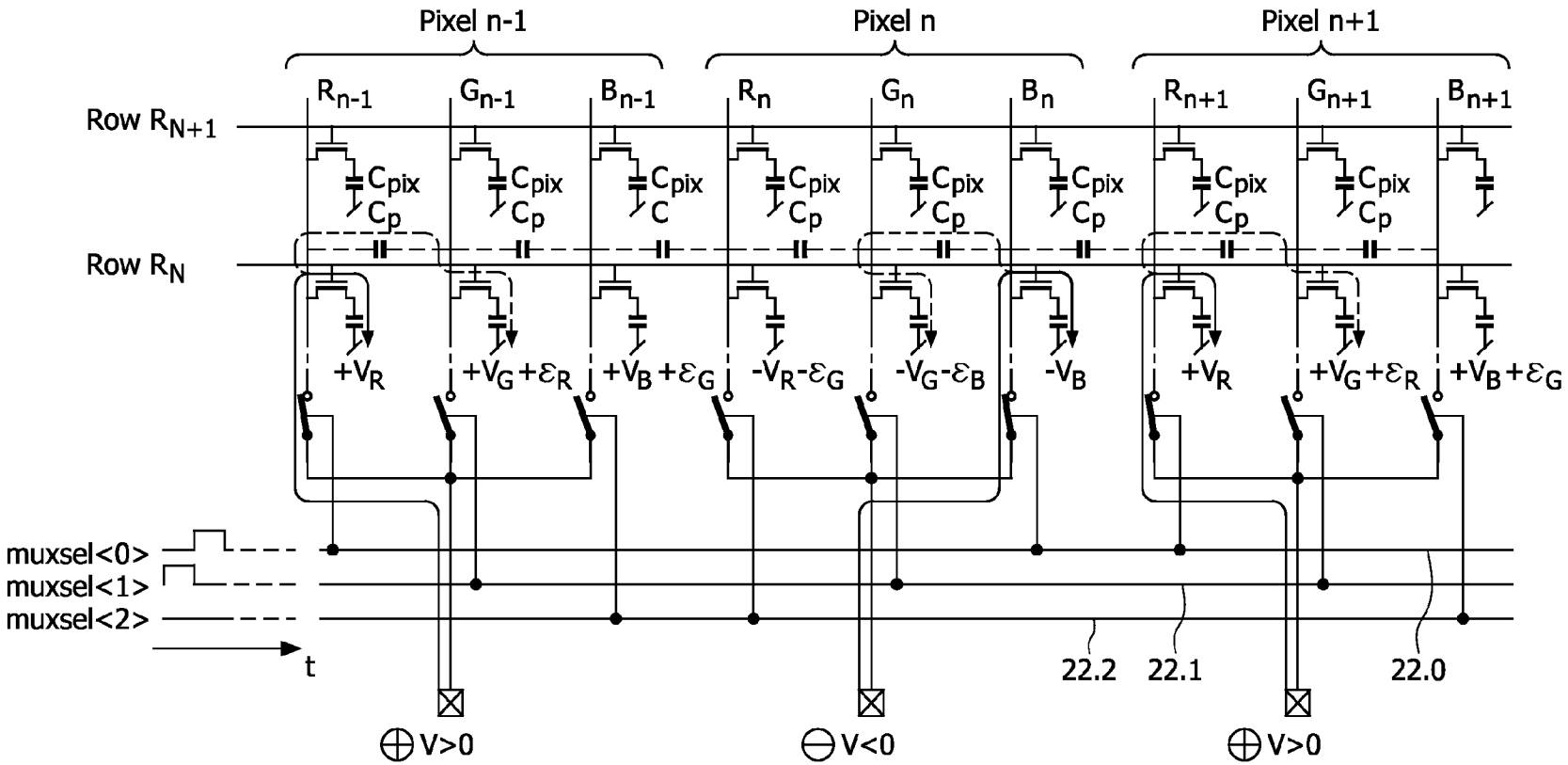

Frame 2 (see FIGS. 5A through 5C):

6. To compensate the color shift, in this $2^{nd}$ frame the polarities of the two sub-pixels adjacent to the middle sub-pixel of each multiplexing group (e.g., sub-pixels ($R_n$ and $B_n$) adjacent to the middle sub-pixel $G_n$) are inverted. The middle one (sub-pixel $G_n$) is charged with the same polarity as in frame 1. The selection order of the neighbor pixel is different with respect to the previous frame to save current consumption, that is the sub-pixel $B_n$ is selected before the sub-pixel $R_n$ is selected. The source lines 19 do not have to be charged to the opposite voltage polarity (cf FIGS. 5A-5C).

Figure 4C:
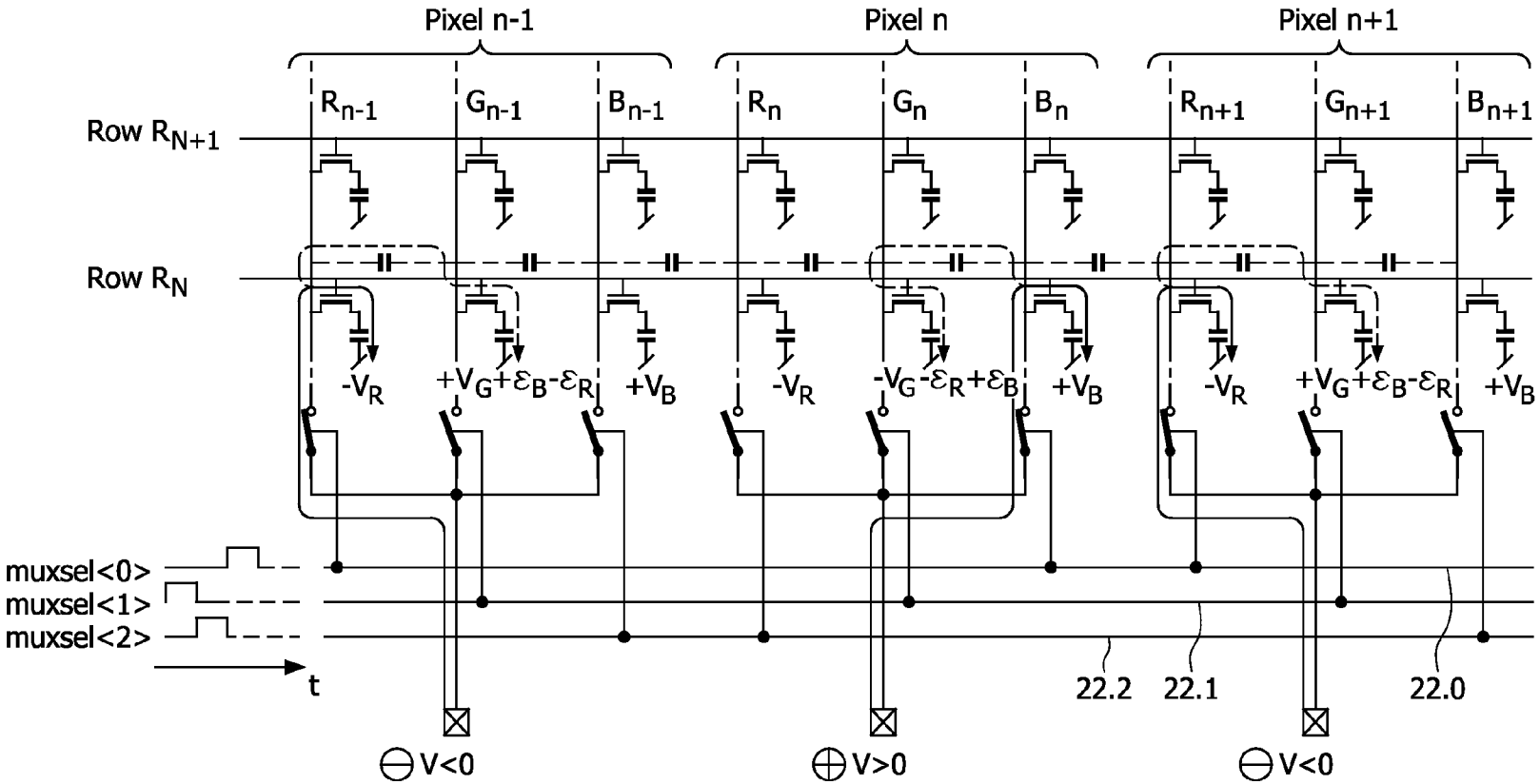
Figure 5C:
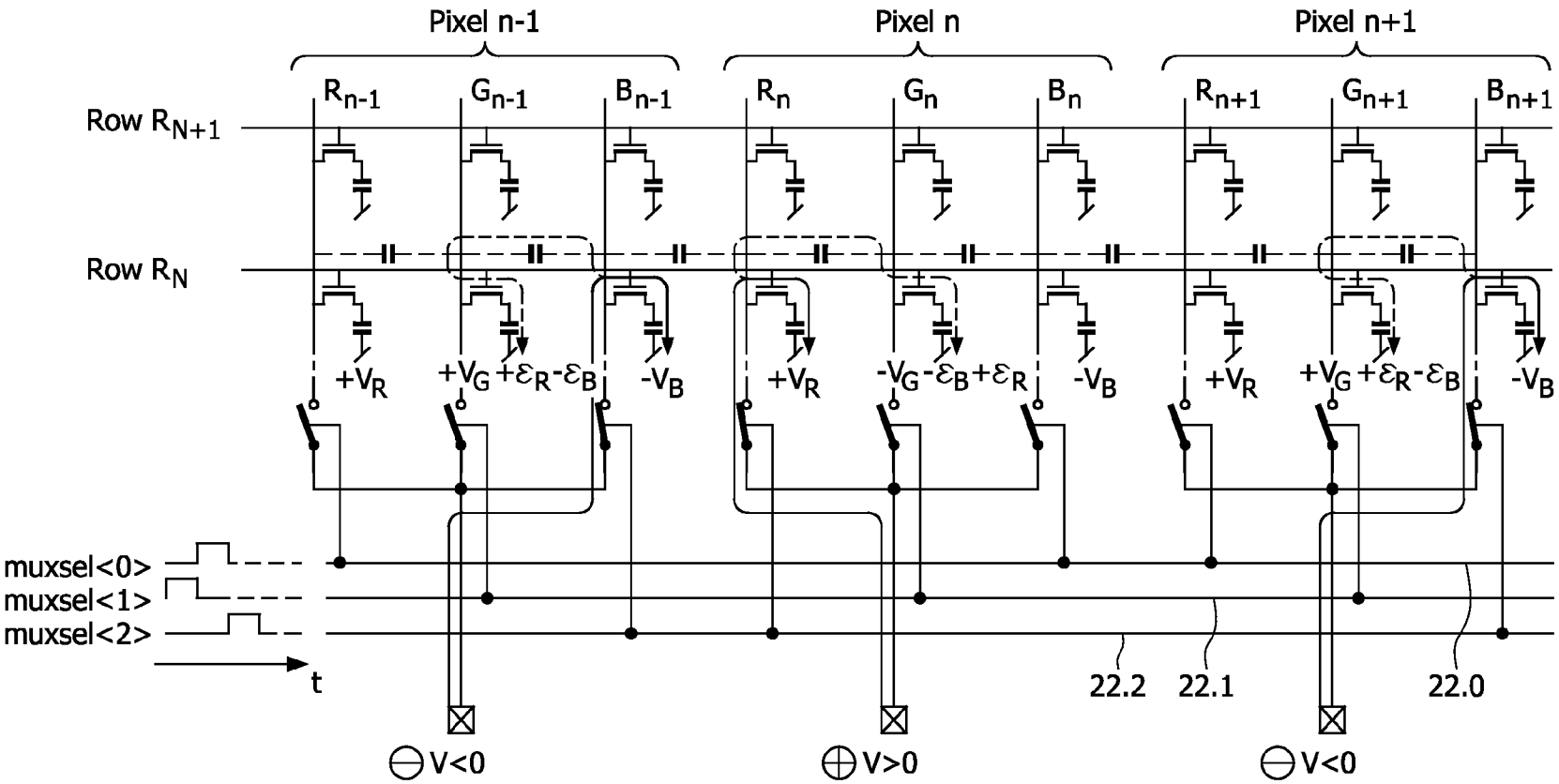
Figure 6A:
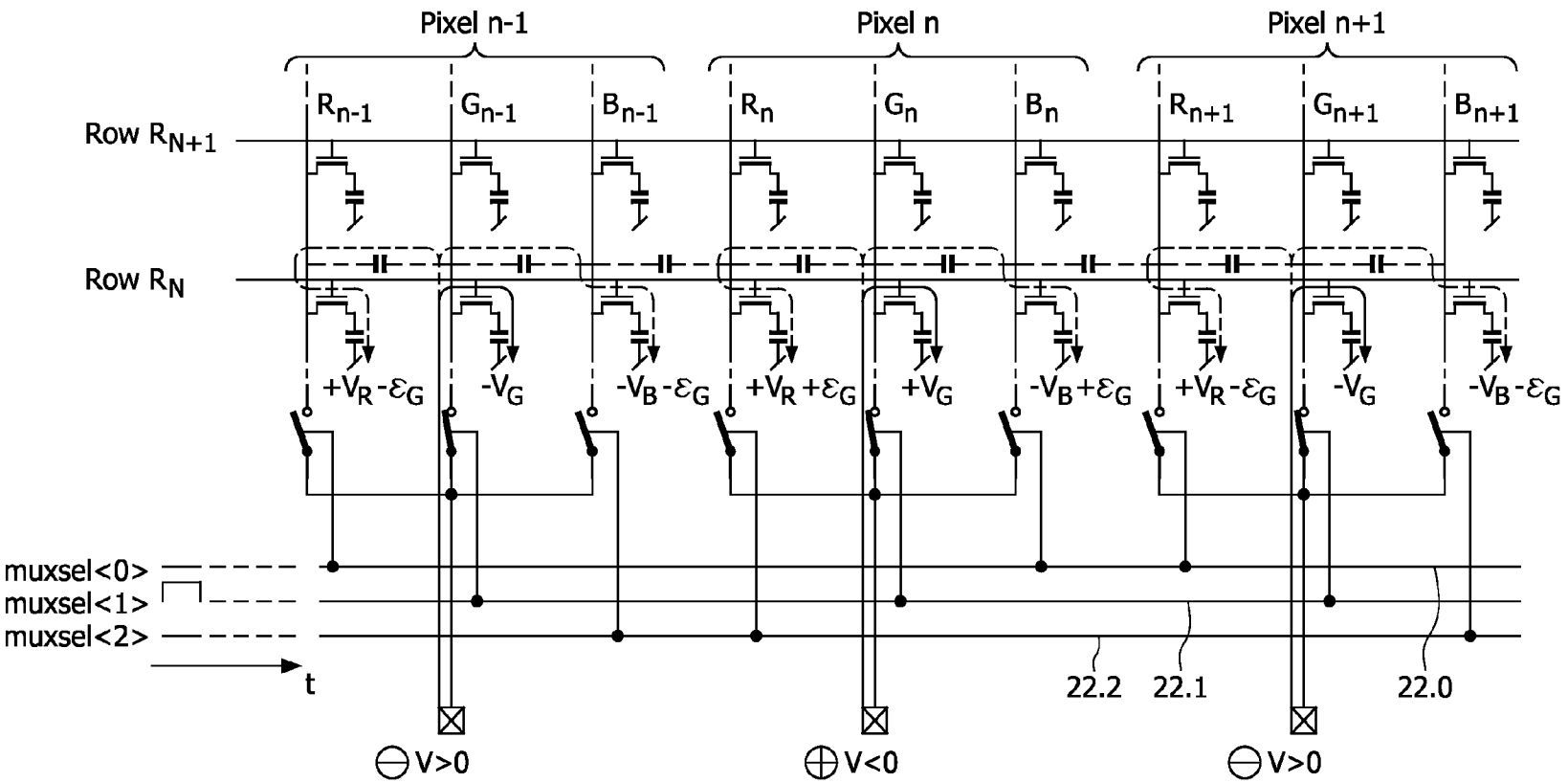
FIGS. 6A-6C are a schematic representation showing part of an active matrix display module and details of the inventive selection scheme and the steps carried out during a third frame.
Figure 6B:
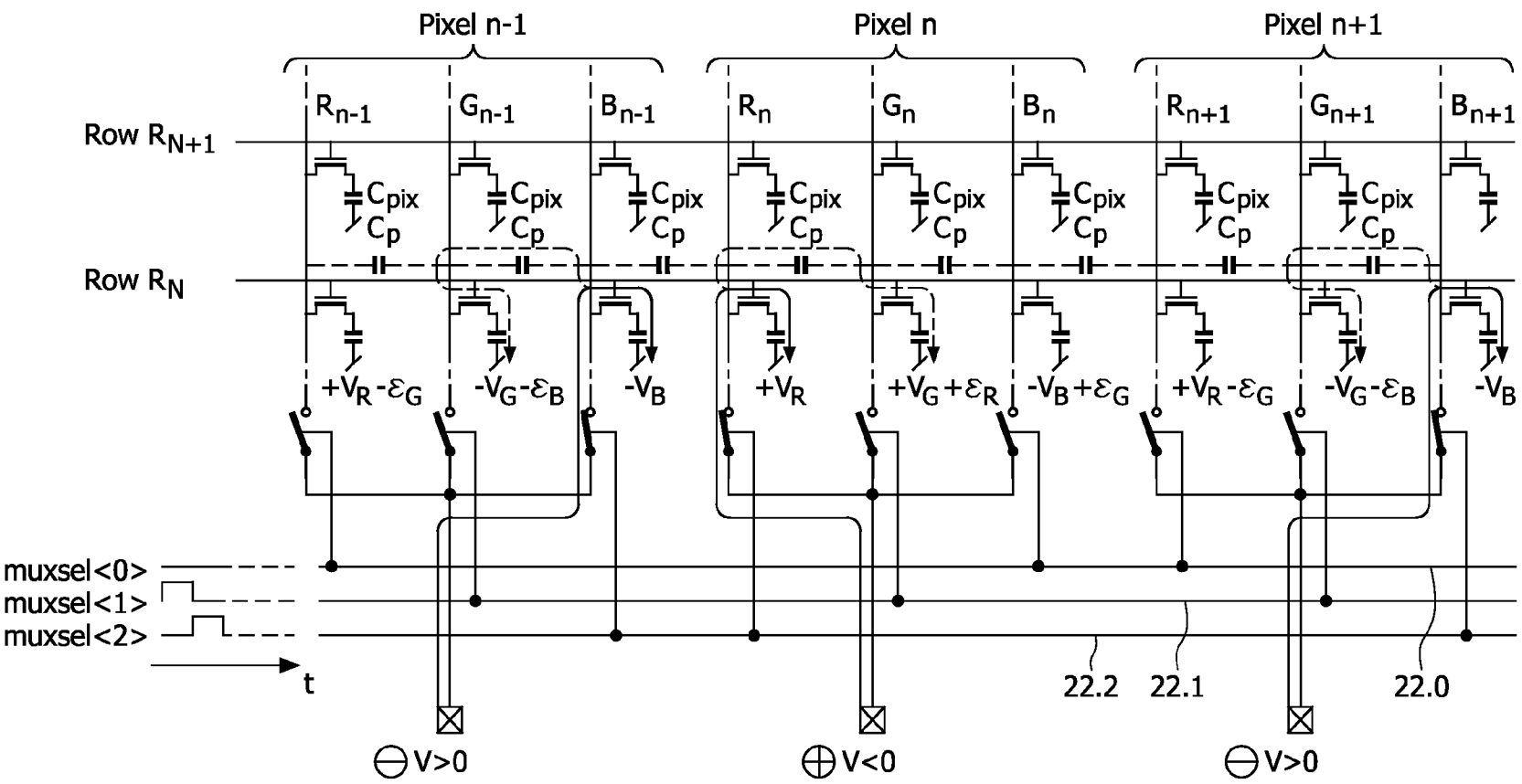
Figure 6C:
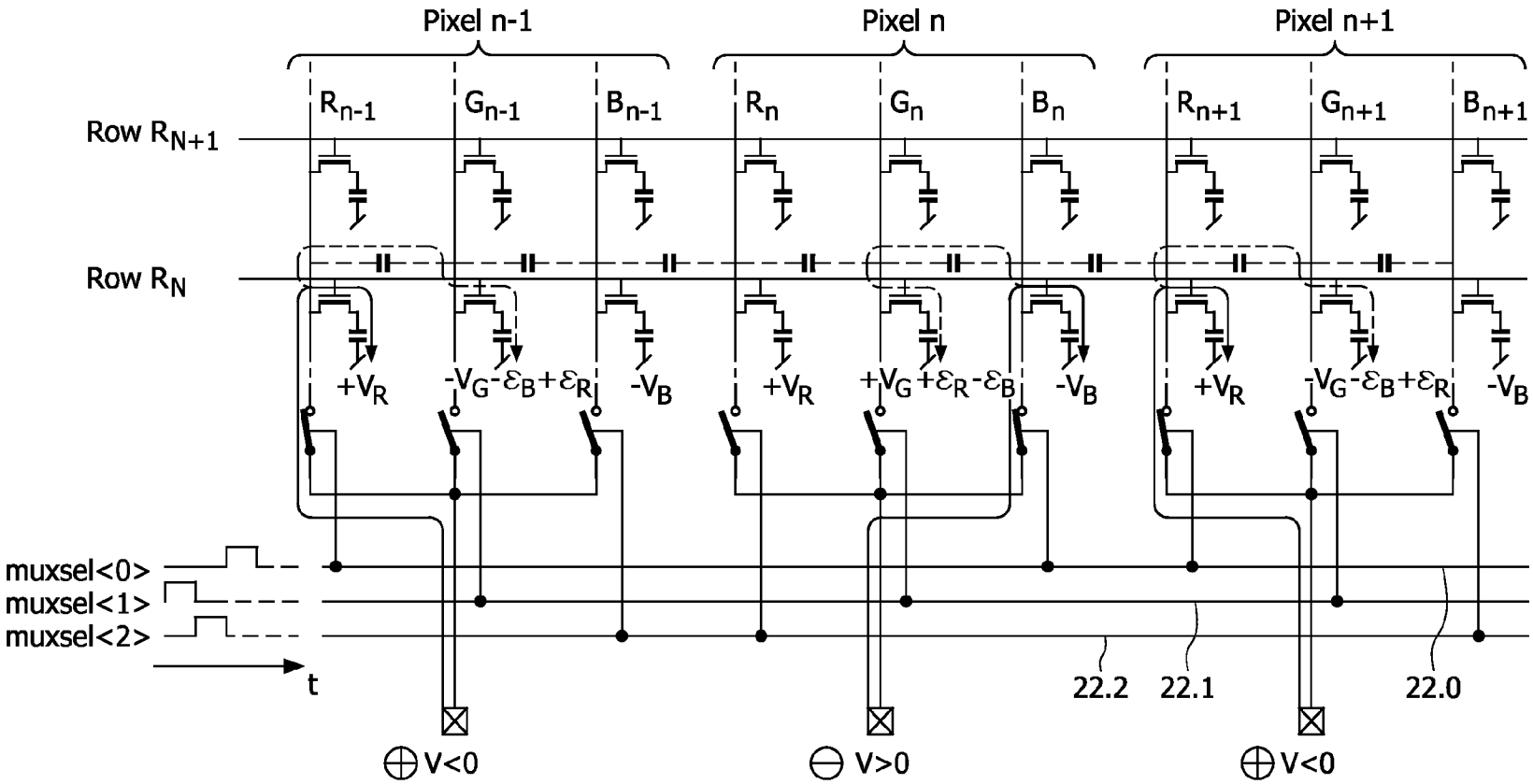
Figure 7A:
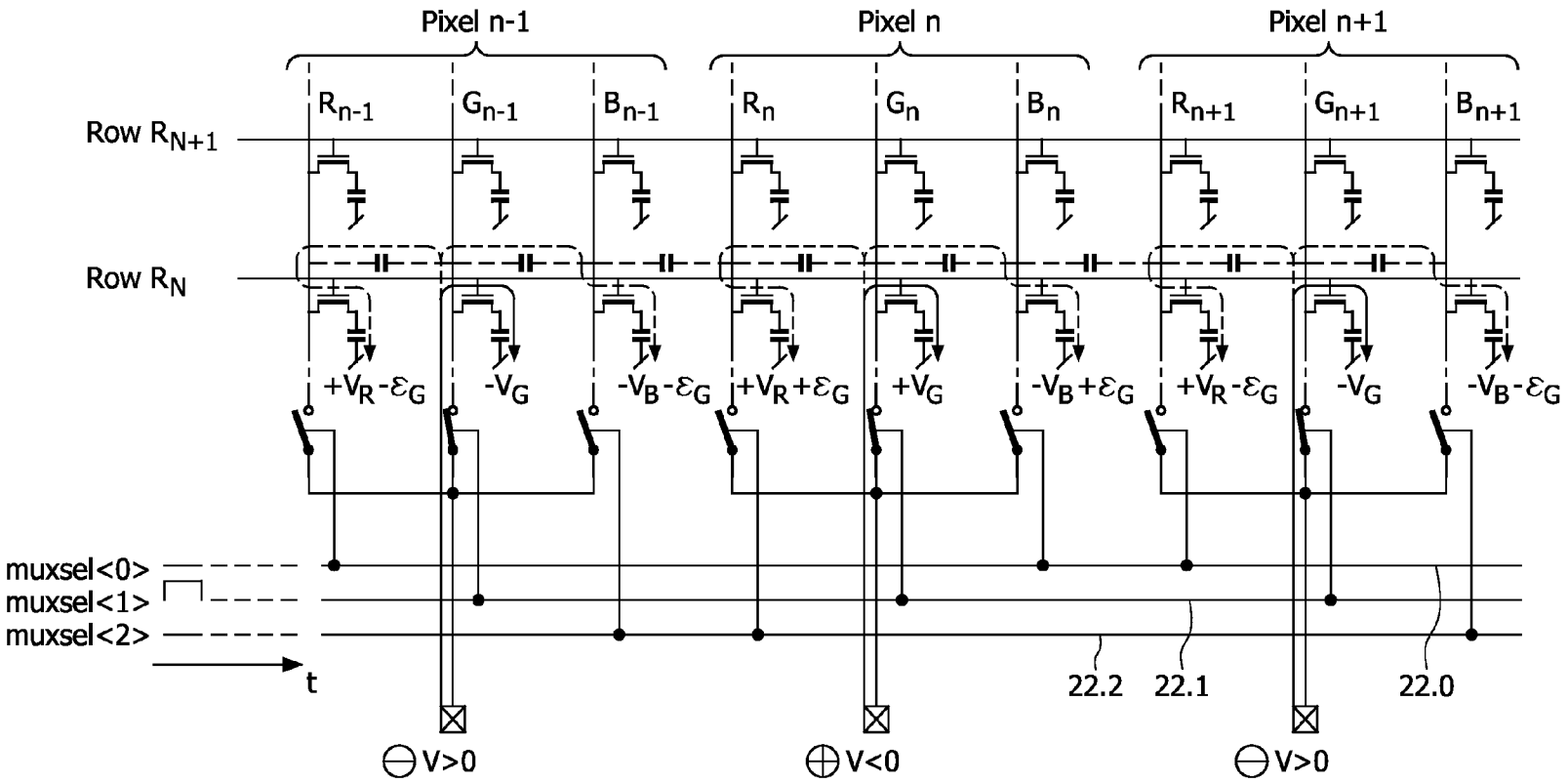
FIGS. 7A-7C are a schematic representation showing part of an active matrix display module and details of the inventive selection scheme and the steps carried out during a fourth frame.
Figure 7B:
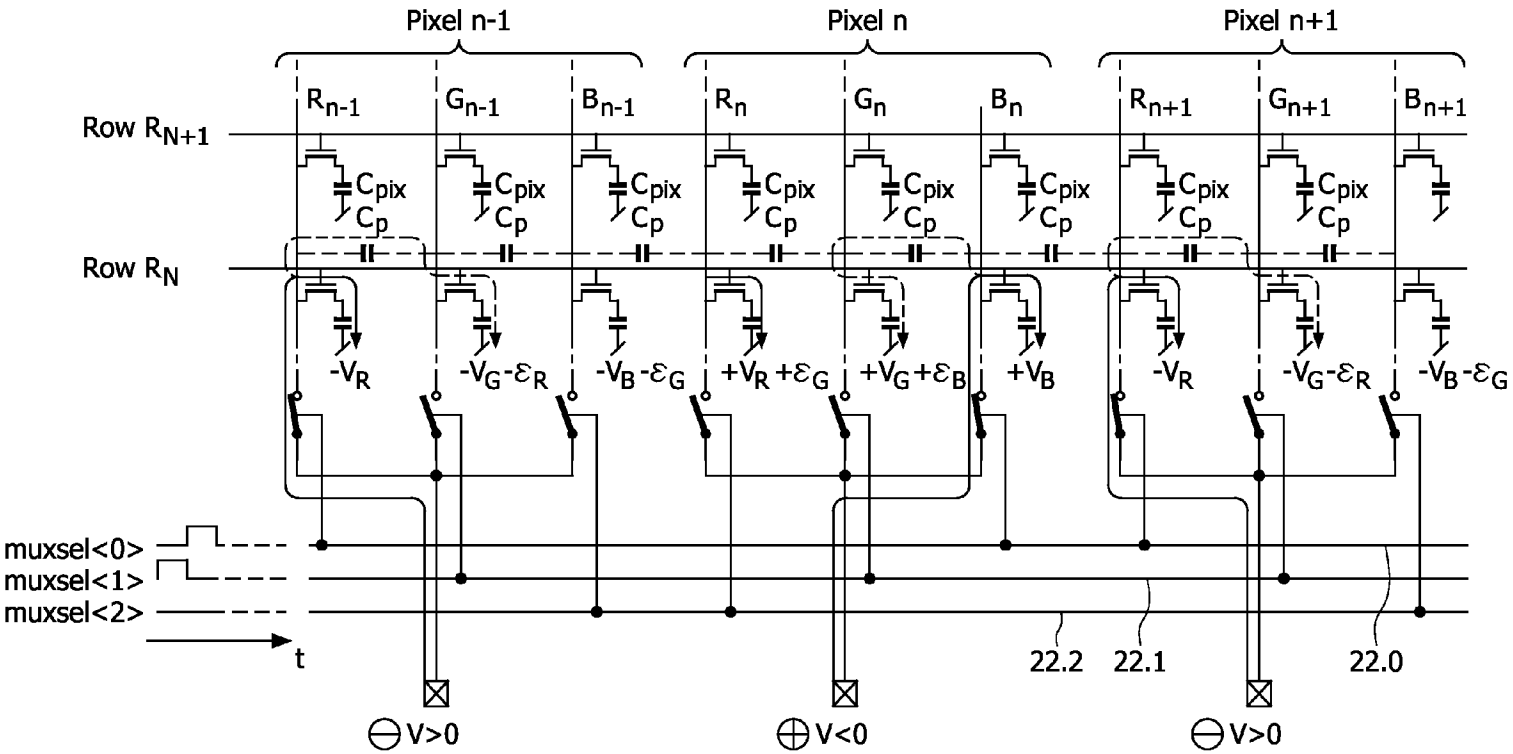
Figure 7C:
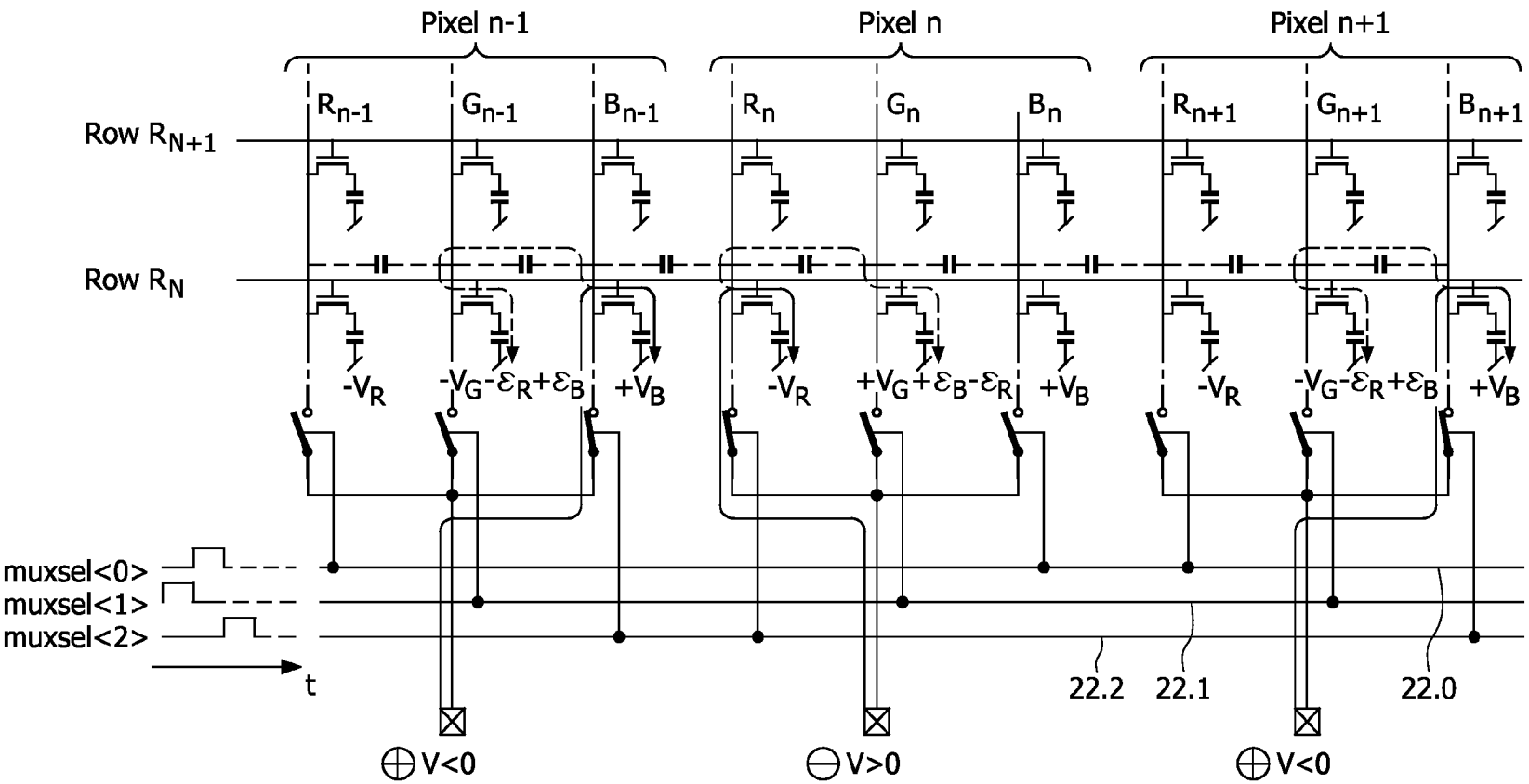

FIGS. 4C and 5C show that the color shifts ϵB and ϵR are compensated by averaging over frame 1 and frame 2 (see the above-mentioned property 3).

7. The step 6 is repeated for every row until the whole display has been addressed.

In this way the frame 2 has been completed and the color shift is compensated. Frames 3 and 4 (see FIGS. 6A through 6C and FIGS. 7A through 7C):

8. To avoid the deterioration of the liquid crystal of the display panel 11 the DC value on each sub-pixel should be averaged out to 0V. To eliminate the DC level on each sub-pixel the two frames 1 and 2 have to be repeated but with inverted polarity (see FIGS. 6A through 6C and FIGS. 7A through 7C).

It is to be noted that the step 8 (carried out during the $3^{rd}$ and $4^{th}$ frame) is optional.

A second embodiment of the invention is designed for a multiplexing rate (mux rate) of 1:6. In this particular embodiment the above-mentioned properties 1, 3, and 4 are being used. It is to be noted that according to the invention other selection orders than described here are possible too.

Figure 8A:
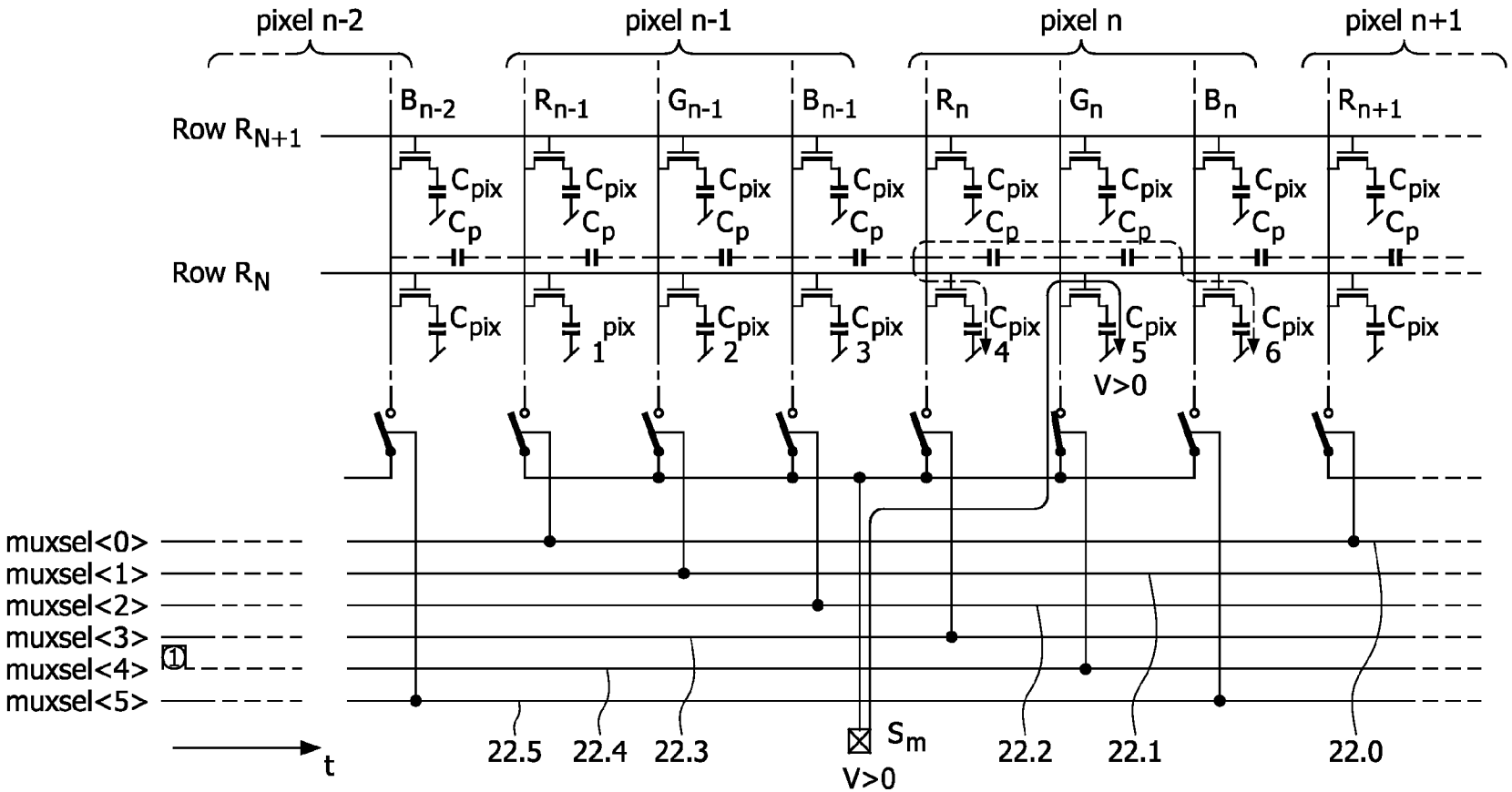
FIGS. 8A-8F are a schematic representation showing part of an active matrix display module and details of the inventive selection scheme and the steps carried out during a first frame.
Figure 8B:
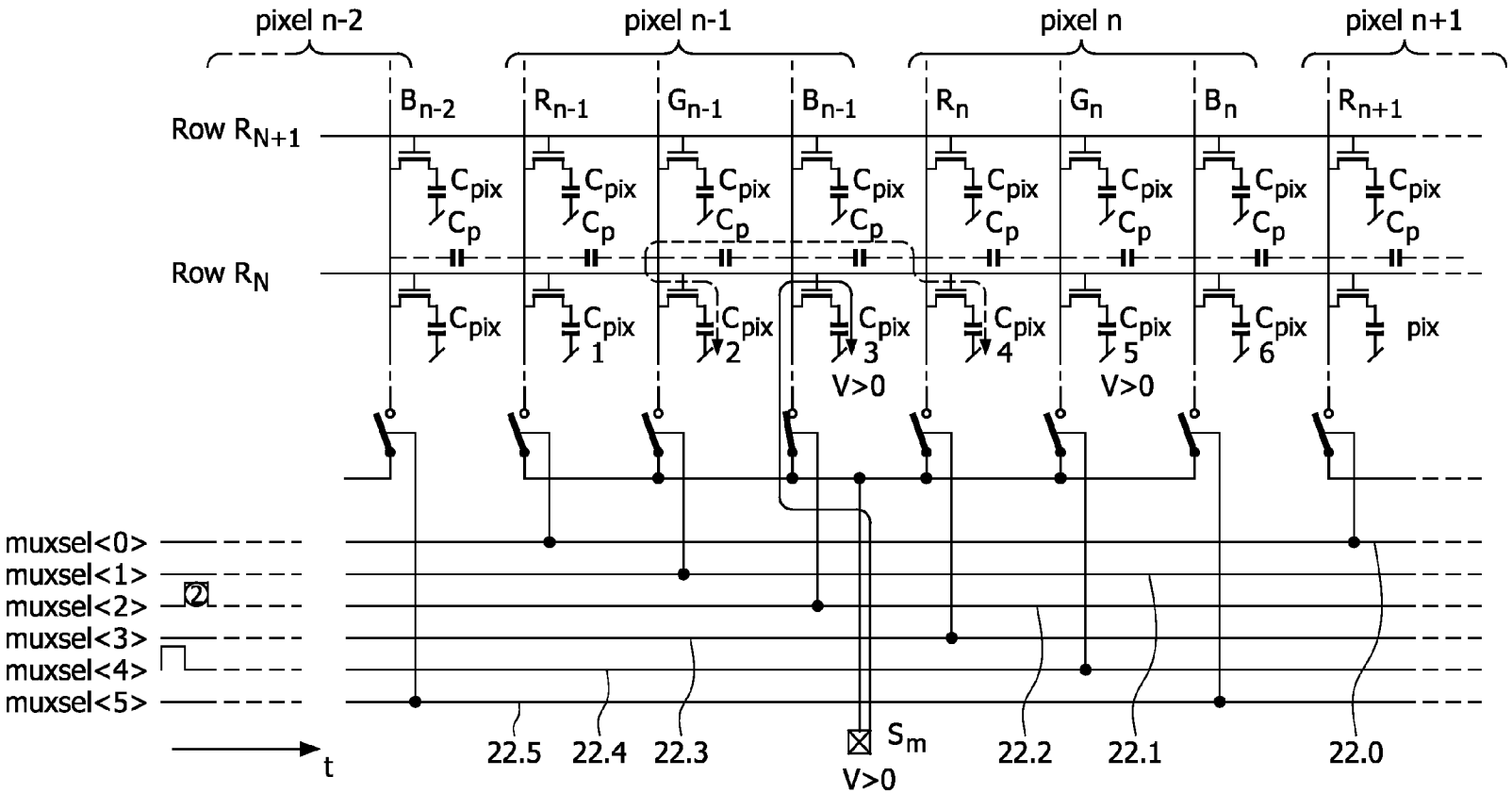
Figure 8C:
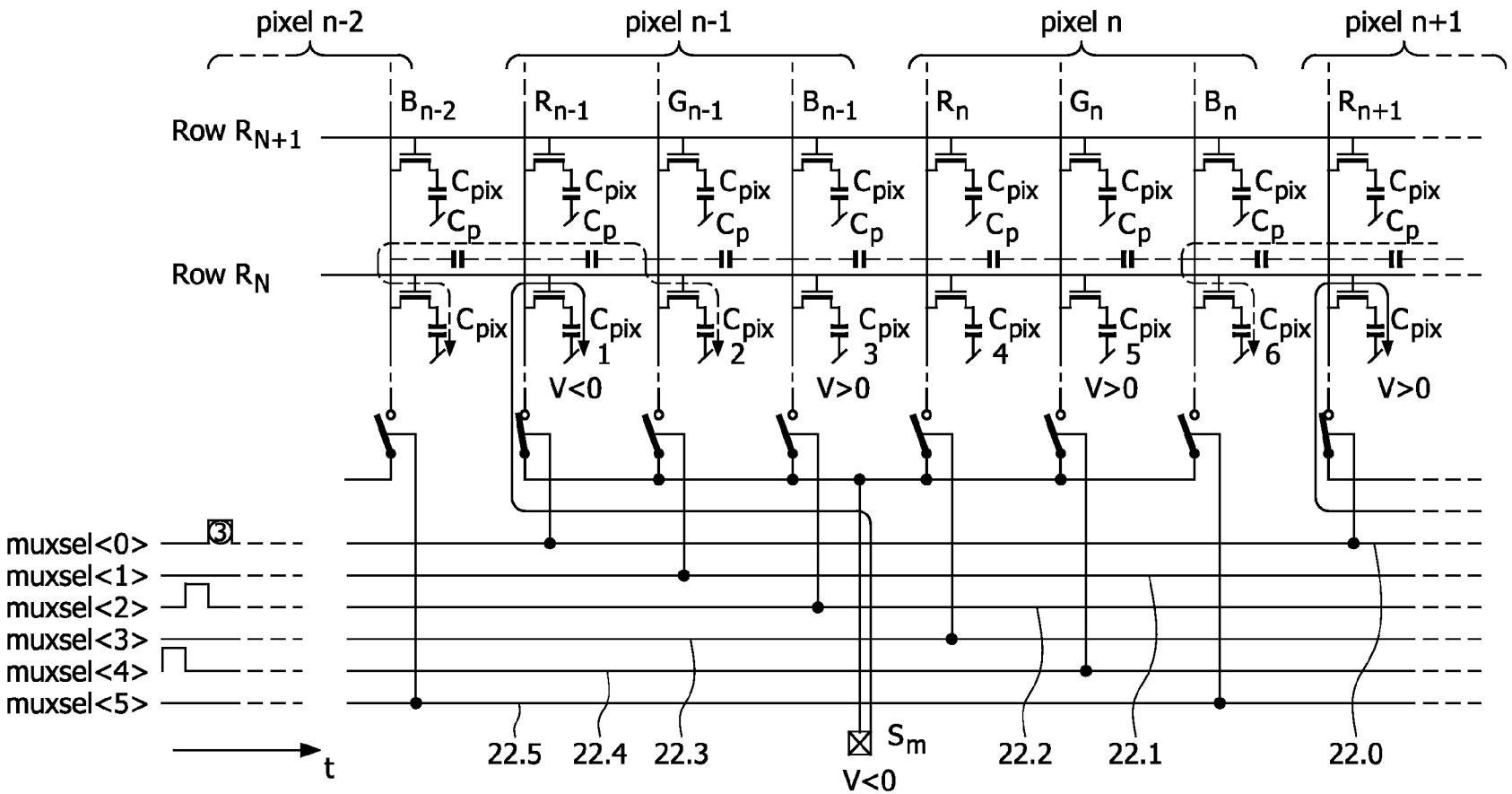

In the following one possible solution is explained, where the charging of the pixels is divided into the following steps:

Frame 1 (see FIGS. 8A through 8F):

1. The row $R_N$ is selected by the gate driver 12.
2. Then three sub-pixels of every demultiplexer group are selected sequentially (respectively in the order: sub-pixels 5, 3, 1, for instance). In FIG. 8A sub-pixel 5 is selected. In FIG. 8B the sub-pixel 3 is selected and in FIG. 8C the sub-pixel 1 is selected. The selection order is such that every second sub-pixel (cf. FIG. 8A to FIG. 8C) will be selected and the others later (cf. step 3 below). In this way the property 4 is used. Like for multiplexer rate 1:3, two demultiplexer groups have always opposite pixel polarities.
3. Then the sub-pixels 4, 2, 6 will be charged sequentially, but in a way that each sub-pixels 5, 3, 1 has on the left and right hand side sub-pixels with inverse polarity (use of property 1) (cf. FIG. 8D to FIG. 8F).
4. The previous steps 1-3 are repeated for every row until the whole display has been addressed.

Figure 8D:
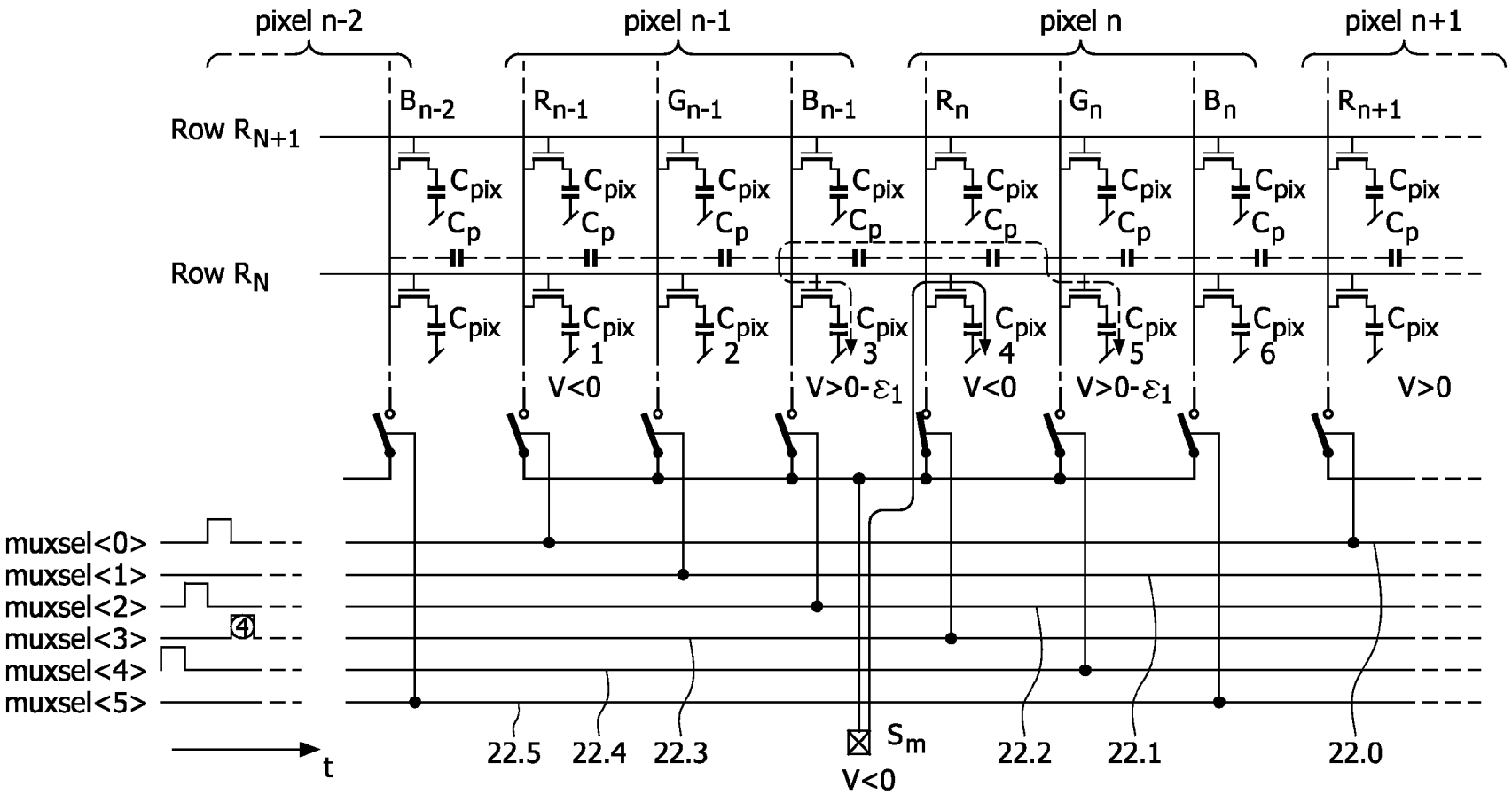
Figure 8E:
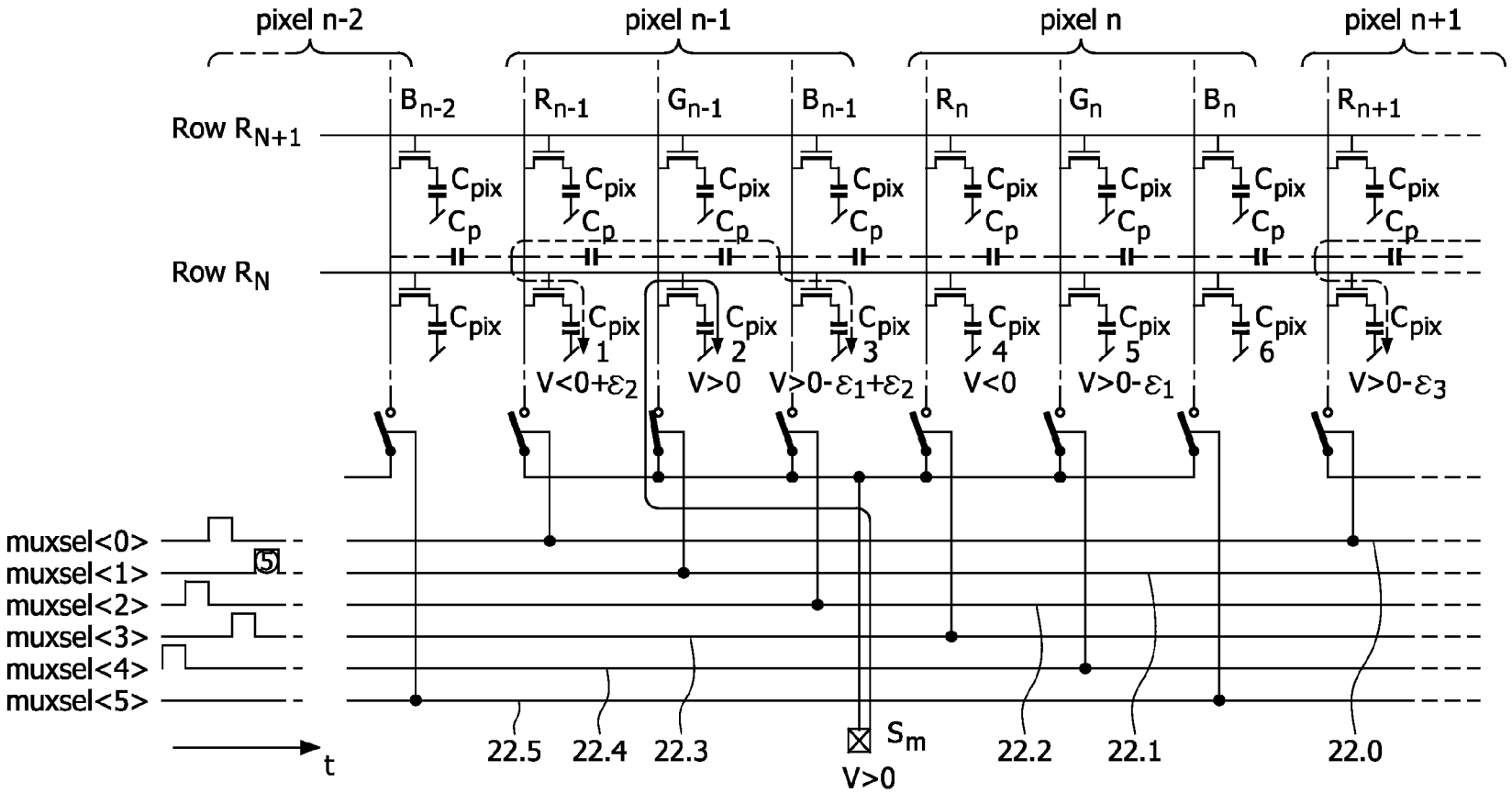
Figure 8F:
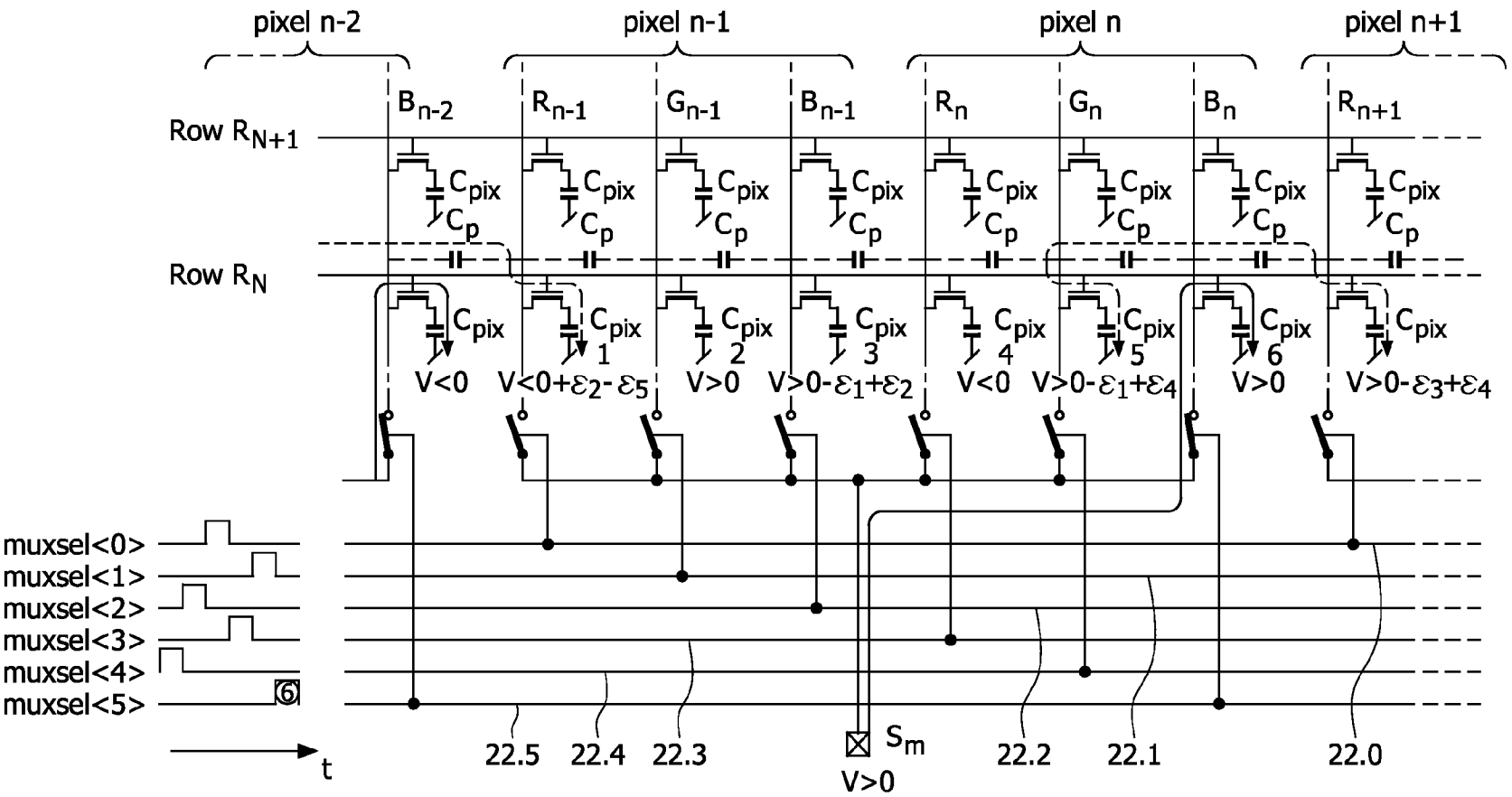

The $1^{st}$ frame is then completed. Through the parasitic capacitor ($C_p$) between source tracks a color shift (respectively ϵ1 to ϵ5) will appear on some sub-pixels, as shown in FIGS. 8D through 8F.

Figure 9A:
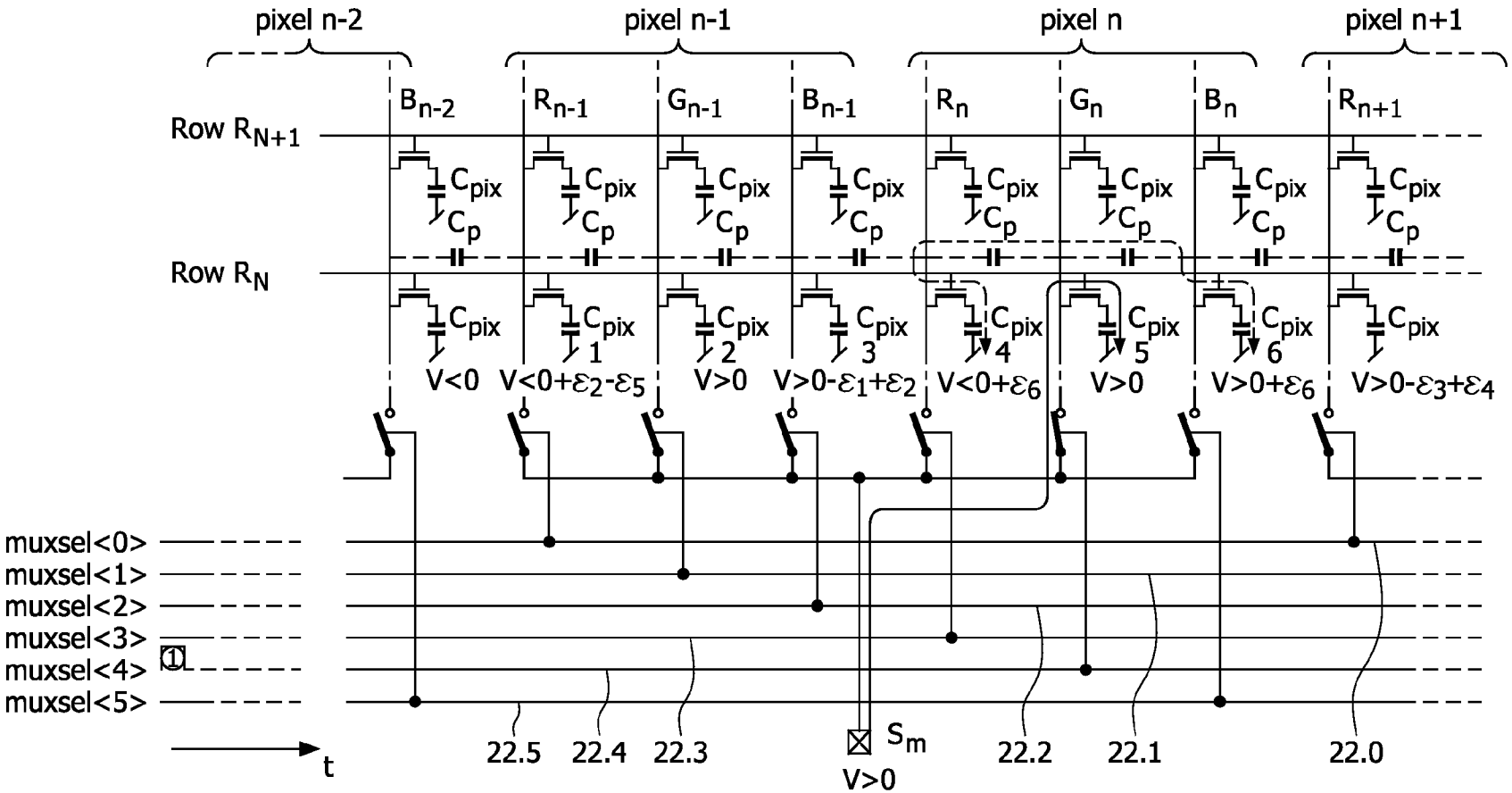
FIGS. 9A-9F are a schematic representation showing part of an active matrix display module and details of the inventive selection scheme and the steps carried out during a second frame.
Figure 9B:
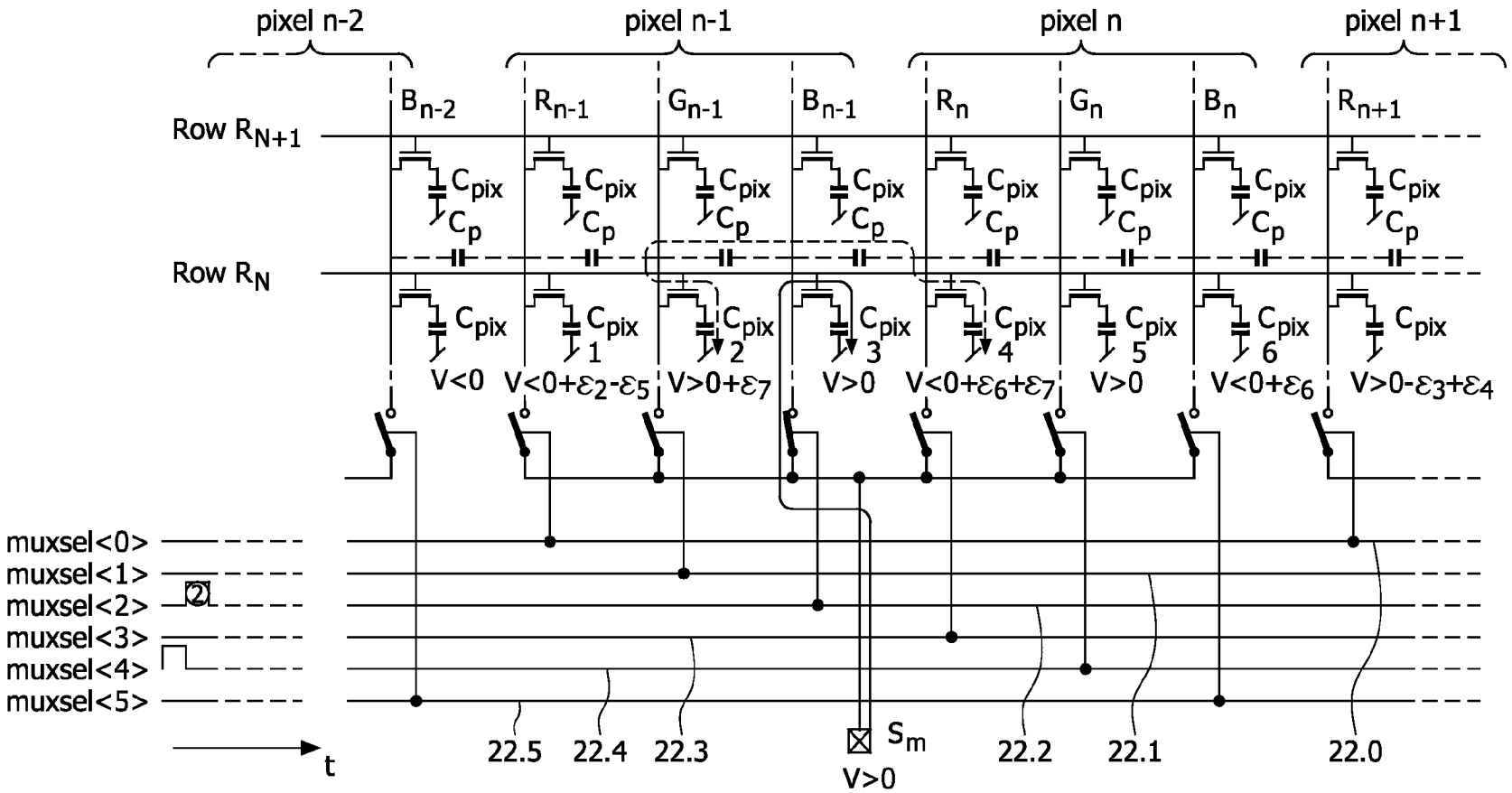
Figure 9C:
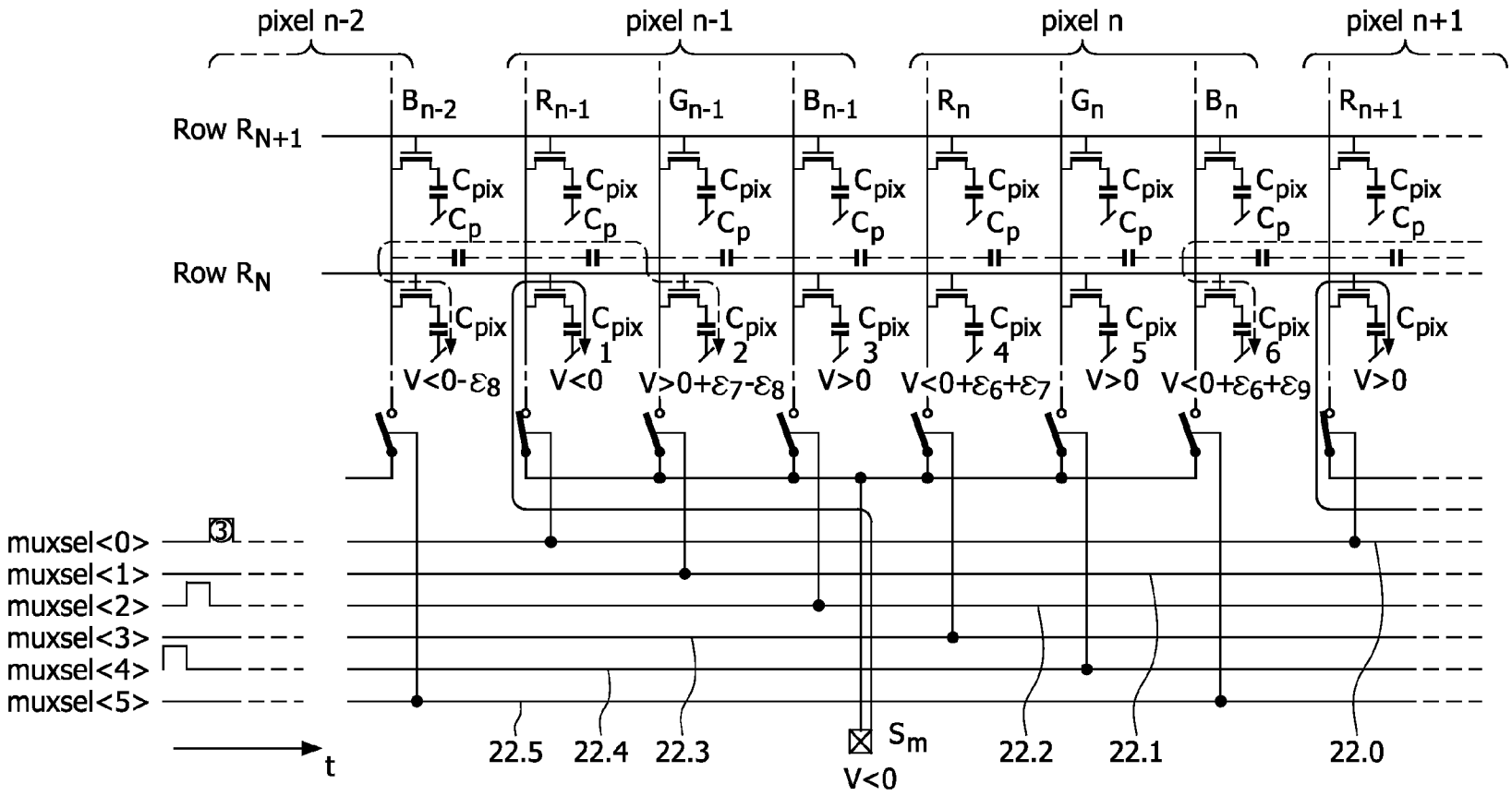
Figure 9D:
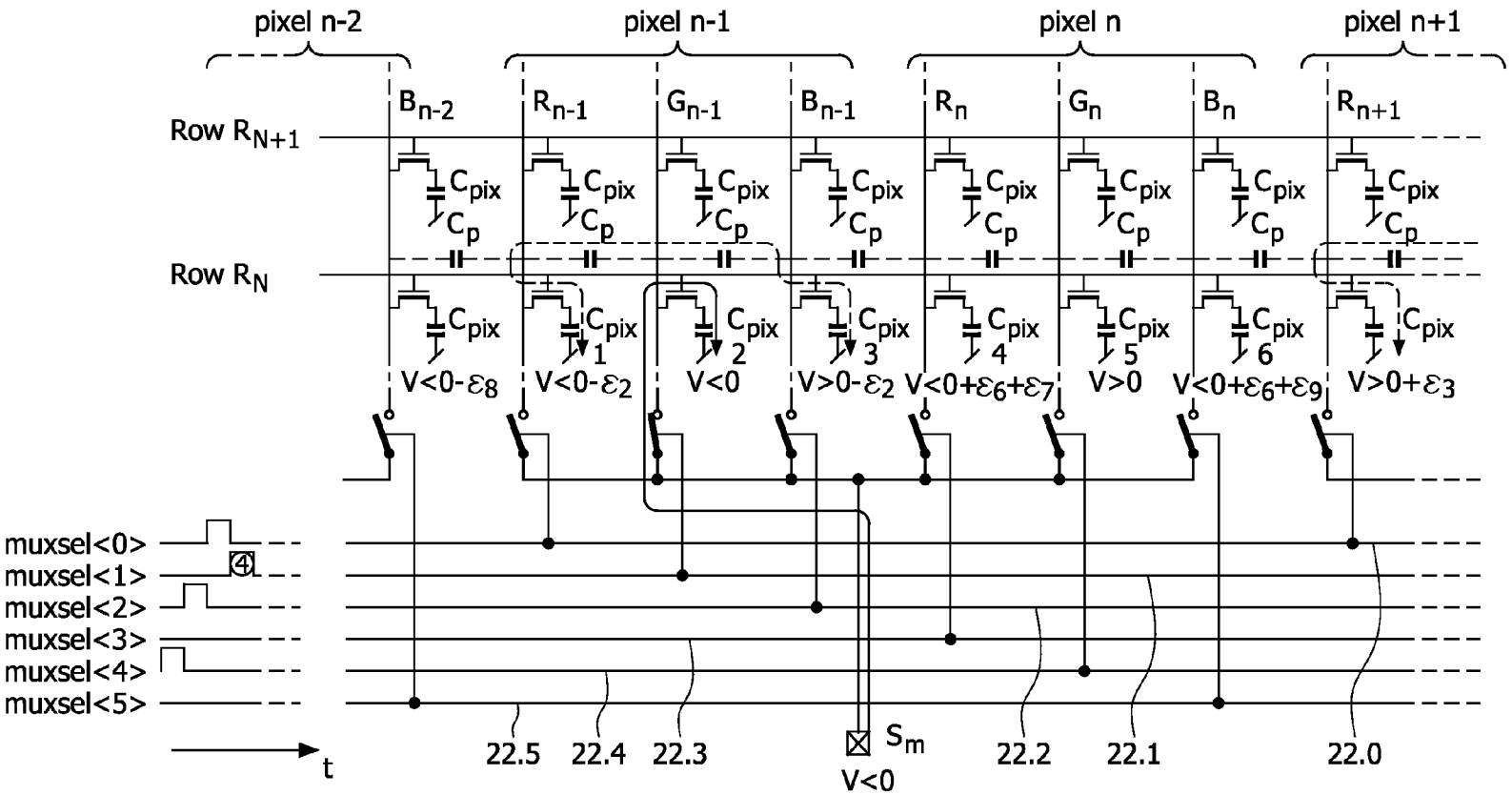
Figure 9E:
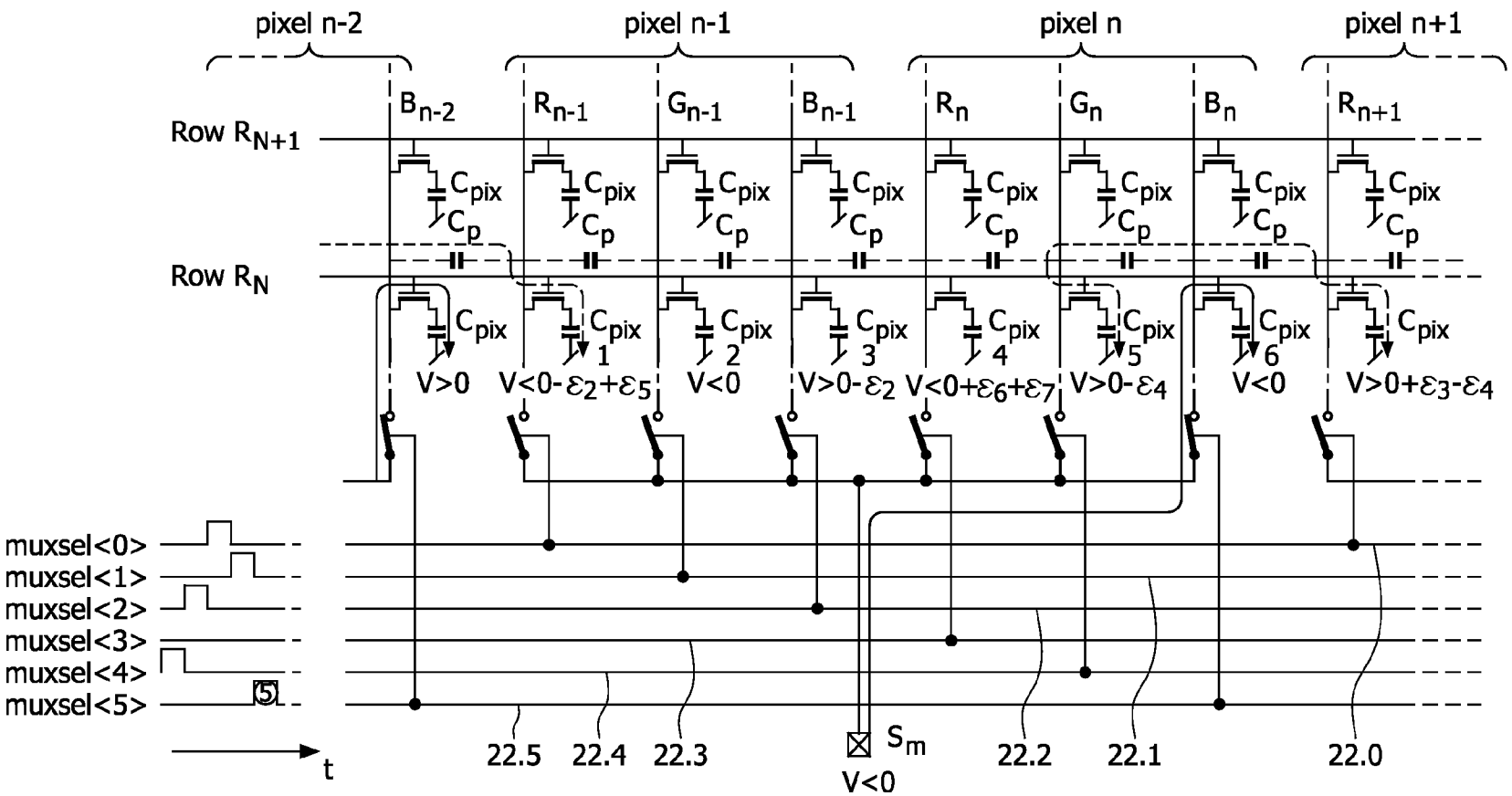
Figure 9F:
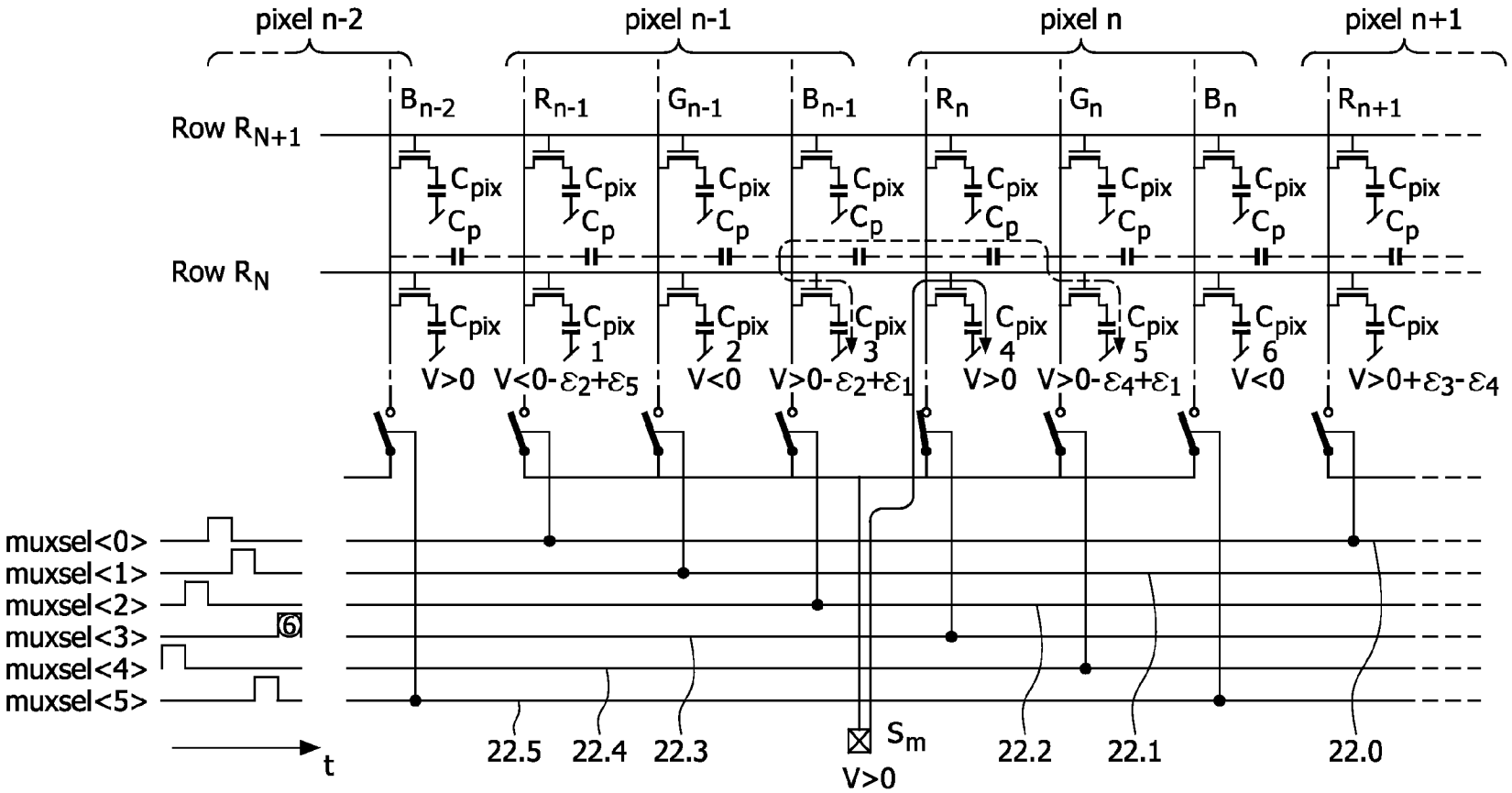

Frame 2 (see FIGS. 9A through 9F):

5. In the next frame the sub-pixels 5, 3, 1 are charged identically to the first frame (FIG. 9A to FIG. 9C).
6. Then the remaining sub-pixels will be charged with the inverse polarity with respect to the previous frame (use of property 3). In order to minimize the current consumption the selection order is respectively: subpixels 2, 6, 4 (FIG. 9D to FIG. 9F). This minimizes the amount of polarity inversions during the charging sequence. Through the parasitic capacitor ($C_p$) between source tracks the color shifts ϵ6 to ϵ9 will appear on some sub-pixels. However, these shifts will be eliminated before the end of the pixel charging sequence and will not influence the displayed image. The remaining color shifts on some pixels (ϵ1 to ϵ5) are eliminated by averaging with frame 1 (compare FIG. 8F and FIG. 9F).
7. The above steps 5 and 6 are repeated for every row until the whole display has been addressed.

In this way the frame 2 has been completed and the color shift is compensated.

Frame 3

8. In the frame 3 the DC value of frame 1 is averaged to 0V on each sub-pixel. This is realized by repeating the same frame as frame 1 but with each sub-pixel charged with inverted polarity with respect to frame 1.

Frame 4

9. In the frame 4 the DC value of frame 2 is averaged to 0V on each sub-pixel. This is realized by repeating the same frame as frame 2 but with each sub-pixel charged with inverted polarity with respect to frame 2.

To avoid the deterioration of the liquid crystal the DC value on each sub-pixel may be averaged out to 0V. This is realized in four frames. However, the color shift is partially compensated in each frame and completely over two frames, i.e. over frame 1 to frame 2 and over frame 3 to frame 4, respectively.

For the purposes of color shift compensation thus two frames are sufficient. A scheme involving 4 frames is only necessary if one also wants avoid the deterioration of the liquid crystal.

The selection order for the selection of the sub-pixels is typically implemented inside the control circuit 18. This control circuit 18 provides the appropriate selection signals taking into account two or more of the properties 1 through 4 identified above.

As mentioned above, the present invention is intended to be used in LCD drivers where the source lines are multiplexed. Very well suited is the present invention for small displays, such as the ones used in mobile phones, PDAs, and the like.

In the drawings and specification there have been set forth preferred embodiments of the invention and, although specific terms are used, the description thus given uses terminology in a generic and descriptive sense only and not for purposes of limitation. In this context it is to be mentioned that the invention was made during the development for an LTPS driver. The invention, as described and claimed herein, however, also applies to other active matrix technologies (such as high temperature polysilicon) too.

What is claimed is:

1. Method for color shift compensation implemented in an active matrix display module comprising a driving circuit with a source driver and a gate driver, and a display panel with pixels consisting of three sub-pixels being arranged in demultiplexing columns, each sub-pixel comprising a sub-pixel selection transistor arranged at an intersection of a row and a column and corresponding demultiplexer selection lines implementing a 1:3 multiplexing scheme where each pixel belongs to a different multiplexing group, the method comprising the following steps:

during a first frame:

(a) selecting a row by the gate driver, (b) charging all sub-pixels in the middle of respective multiplexing groups of said row, each multiplexing group consisting of three sub-pixels, with respective predetermined voltage polarities by respective source driver lines responsive to application of a respective signal pulse on a corresponding demultiplexer selection line, (c) charging one of the two neighboring sub-pixels of the middle sub-pixel of each multiplexing group of said row with a first voltage polarity, and selecting an adjacent sub-pixel of an adjacent multiplexing group at the same time, (d) charging the other neighbor sub-pixel of the middle sub-pixel of each multiplexing group of said row with a second voltage polarity opposite to the first voltage polarity, whereby two sub-pixels of the two adjacent multiplexing groups are selected simultaneously, (e) repeating the steps (a)-(d) for every row until the whole display panel is addressed, during a second, subsequent frame:

(f) inverting the respective polarities of the two neighboring sub-pixels of the middle sub-pixel of each multiplexing group of a row and charging the respective middle sub-pixels with the respective predetermined voltage polarities, (g) repeating the step (f) for every row until the whole display has been addressed.

2. The method of claim 1 whereby the steps at said first and second frames are repeated with inverted polarity at each sub-pixel in order to average out the DC value on each sub-pixel to 0V.

* * * * *